US012727635B2

(12) United States Patent
Horner et al.

(10) Patent No.: US 12,727,635 B2
(45) **Date of Patent: *Sep. 8, 2026**

(54) LAYERED THUMBHOLE STRUCTURE

(71) Applicant: NIKE, Inc., Beaverton, OR (US)

(72) Inventors: Stewart D. Horner, Portland, OR (US); Iustinia Koshkaroff, Portland, OR (US); Matthew D. Nordstrom, Portland, OR (US); Michelle L. Feazell, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/029,619

(22) Filed: Jan. 17, 2025

(65) Prior Publication Data

US 2025/0160458 A1 May 22, 2025

Related U.S. Application Data

(63) Continuation of application No. 18/243,237, filed on Sep. 7, 2023, now abandoned, which is a continuation (Continued)

(51) Int. Cl.
*A41D 27/10* (2006.01)
*A41B 1/08* (2006.01)

(Continued)

(52) U.S. Cl.
CPC ..... *A41D 27/10* (2013.01); *A41B 1/08* (2013.01); *A41B 7/00* (2013.01); *A41B 7/02* (2013.01); *A41D 13/08* (2013.01); *A41D 27/24* (2013.01)

(58) Field of Classification Search
CPC ..... A41D 27/10; A41D 13/08; A41D 27/24; A41B 1/08; A41B 7/00; A41B 7/02; A41B 7/04; A41B 7/08; A41B 7/10; A41B 7/12

(Continued)

(56) References Cited

U.S. PATENT DOCUMENTS 415,676 A 11/1889 Magee
948,142 A 2/1910 Karp (Continued)

FOREIGN PATENT DOCUMENTS

DE 0847733 C 8/1952
DE 8704993 U1 6/1987

(Continued)

OTHER PUBLICATIONS

Notice of Allowance received for Canadian Patent Application No. 3145886, mailed on Aug. 29, 2025, 1 page.

(Continued)

*Primary Examiner* — Jameson D Collier

(74) *Attorney, Agent, or Firm* — Shook, Hardy & Bacon L.L.P.

(57) ABSTRACT

A sleeve cuff is provided for a sleeve having an anterior patch affixed to the sleeve and covering at least a portion of a cutout in the sleeve, a distal strap affixed to the sleeve and spanning over at least a portion of a cutout in the sleeve, and the distal strap overlapping at least a portion of the anterior patch to form an aperture for receiving a thumb therethrough. The sleeve cuff has a plurality of configurations, including at least a closed configuration where the aperture is closed and minimizes the wearer's exposure to wind and air elements therethrough, and an opened configuration where the aperture is opened and minimizes the air penetration around the received thumb.

15 Claims, 17 Drawing Sheets

Related U.S. Application Data of application No. 18/076,720, filed on Dec. 7, 2022, now Pat. No. 12,041,993, which is a continuation of application No. 16/552,676, filed on Aug. 27, 2019, now Pat. No. 11,540,571, which is a continuation-in-part of application No. 15/493,468, filed on Apr. 21, 2017, now Pat. No. 10,383,382, which is a continuation of application No. 15/045,465, filed on Feb. 17, 2016, now Pat. No. 9,681,689.

(60) Provisional application No. 62/242,760, filed on Oct. 16, 2015, provisional application No. 62/118,288, filed on Feb. 19, 2015.

(51) Int. Cl.

| | |
|---|---|
| ***A41B 7/00*** | (2006.01) |
| ***A41B 7/02*** | (2006.01) |
| ***A41D 13/08*** | (2006.01) |
| ***A41D 27/24*** | (2006.01) |

(58) Field of Classification Search
USPC ..... 2/16, 59, 60, 123, 125, 270
See application file for complete search history.

(56) References Cited

U.S. PATENT DOCUMENTS 948,412 A 2/1910 Buissono
1,012,648 A 12/1911 Karp
1,338,098 A 4/1920 Schneider
1,525,322 A 2/1925 Post
1,784,158 A 12/1930 Place
1,982,845 A 12/1934 Wagman
2,057,713 A 10/1936 Edelson
2,084,173 A 6/1937 Wexler
2,150,171 A 3/1939 Erwin
2,160,682 A 5/1939 Silber
2,170,339 A 8/1939 Reeves
2,264,314 A 12/1941 Johns
2,686,913 A 8/1954 Brierley
2,715,226 A 8/1955 Weiner, I.
2,803,824 A 8/1957 Parish
2,836,828 A 6/1958 Henrikson
3,045,243 A 7/1962 Seymour et al.
3,086,215 A 4/1963 Di Paola
3,153,793 A 10/1964 Lepore
3,296,626 A 1/1967 Ludwikowski
3,496,572 A 2/1970 Benno
3,698,014 A 10/1972 Little et al.
3,706,102 A 12/1972 Grenier
4,034,417 A 7/1977 Ellis
4,170,793 A 10/1979 O'Brien
4,344,999 A 8/1982 Gohlke
4,408,356 A 10/1983 Abrams
4,454,191 A 6/1984 Von et al.
4,513,451 A 4/1985 Brown
4,530,873 A 7/1985 Okada
4,569,874 A 2/1986 Kuznetz
4,665,563 A 5/1987 Harvey
4,722,099 A 2/1988 Kratz
4,756,027 A 7/1988 Buenos et al.
4,810,559 A 3/1989 Fortier et al.
4,868,928 A 9/1989 Norvell
4,924,529 A * 5/1990 Grilliot ..... A41D 27/10 2/93
5,035,000 A 7/1991 Matthias
D319,113 S 8/1991 Adams
5,097,534 A 3/1992 Viemeister et al.
5,204,156 A 4/1993 Lumb et al.
5,274,850 A 1/1994 Aldridge
5,378,529 A 1/1995 Bourdeau
5,388,270 A 2/1995 Hewitt
5,504,944 A 4/1996 Bromer et al.
5,642,526 A 7/1997 Thompson
5,687,423 A 11/1997 Ross
5,704,064 A 1/1998 Van Der Sleesen
5,727,256 A 3/1998 Rudman
5,752,277 A 5/1998 Van Der Sleesen
5,784,720 A 7/1998 Mellon et al.
5,794,265 A 8/1998 Reich
5,815,837 A 10/1998 Christman et al.
5,845,336 A 12/1998 Golde
5,867,825 A 2/1999 Scheerer
5,913,408 A 6/1999 Shanahan
5,953,758 A 9/1999 Foster
6,070,274 A 6/2000 Van Der Sleesen
6,076,189 A 6/2000 Christman et al.
6,085,353 A 7/2000 Van Der Sleesen
6,122,772 A 9/2000 De Guzman
6,163,883 A 12/2000 Hong
6,253,381 B1 7/2001 Kelley
6,263,511 B1 7/2001 Moretti
6,332,221 B1 12/2001 Gracey
6,339,845 B1 1/2002 Burns et al.
D457,709 S 5/2002 Davis
6,432,504 B1 8/2002 Yeh
6,449,772 B1 9/2002 Donner
6,511,927 B1 1/2003 Ellis et al.
6,654,963 B2 12/2003 Fayle et al.
6,665,878 B1 12/2003 Way
6,766,565 B2 7/2004 Crye et al.
6,874,162 B2 4/2005 Boezi
6,996,847 B2 2/2006 Anderson et al.
7,043,766 B1 5/2006 Foreman et al.
7,168,098 B2 1/2007 West
7,310,825 B2 12/2007 St-Germain
7,380,286 B1 6/2008 Bryant, Sr.
7,418,740 B2 9/2008 Anderson et al.
7,428,772 B2 9/2008 Rock
7,540,037 B1 6/2009 Bittler et al.
7,560,399 B2 7/2009 Rock et al.
7,568,238 B2 8/2009 Schossberger et al.
7,682,994 B2 3/2010 Van et al.
7,779,485 B2 8/2010 Gandy
7,856,669 B2 12/2010 Sommers et al.
8,043,240 B2 10/2011 Piatek
8,133,824 B2 3/2012 Harber
D657,532 S 4/2012 Gaeir et al.
8,187,984 B2 5/2012 Rock
8,192,824 B2 6/2012 Rock et al.
8,349,438 B2 1/2013 Laib et al.
8,438,665 B2 5/2013 Roemer et al.
8,453,264 B2 6/2013 Mickle et al.
8,453,270 B2 6/2013 Blackford
8,454,784 B2 6/2013 Colasanto et al.
8,479,313 B2 7/2013 Jones
8,601,612 B2 12/2013 Funk-Danielson
D707,974 S 7/2014 Blackford
8,850,615 B2 10/2014 Demarest et al.
D720,119 S 12/2014 Pankhurst et al.
8,910,313 B2 12/2014 Gordon et al.
9,009,865 B2 4/2015 Gilreath
9,032,550 B2 5/2015 Lambertz
9,060,551 B2 6/2015 Nordstrom et al.
9,062,913 B2 6/2015 Araujo et al.
9,090,998 B2 7/2015 Williams
9,681,689 B2 6/2017 Horner et al.
10,349,687 B2 7/2019 Baschak et al.
10,660,387 B2 5/2020 Horner et al.
11,317,664 B2 5/2022 Horner et al.
11,540,571 B2 1/2023 Horner et al.
11,589,628 B2 2/2023 Horner et al.
11,638,453 B2 * 5/2023 Eckensweiler ..... A41D 15/002 2/125
11,839,248 B2 12/2023 Horner et al.
12,041,993 B2 7/2024 Horner et al.
2003/0104734 A1 6/2003 Polegato Moretti
2003/0140404 A1 7/2003 Golde
2003/0154536 A1 8/2003 Anderson et al.
2004/0064870 A1 4/2004 Gold
2004/0132367 A1 7/2004 Rock
2004/0237168 A1 12/2004 Braun
2005/0070189 A1 3/2005 Thiriot

(56) References Cited

U.S. PATENT DOCUMENTS

| | | | |
|---|---|---|---|
| 2005/0172378 | A1 | 8/2005 | Messiou |
| 2005/0172381 | A1 | 8/2005 | Bush |
| 2005/0208857 | A1 | 9/2005 | Baron et al. |
| 2005/0273903 | A1 | 12/2005 | Rudman |
| 2006/0000005 | A1 | 1/2006 | Foreman et al. |
| 2006/0035555 | A1 | 2/2006 | Narayanan et al. |
| 2006/0101554 | A1 | 5/2006 | St-Germain |
| 2006/0179539 | A1 | 8/2006 | Harber |
| 2006/0223400 | A1 | 10/2006 | Yasui et al. |
| 2006/0277652 | A1 | 12/2006 | Okajima |
| 2007/0093162 | A1 | 4/2007 | Holcombe et al. |
| 2007/0118960 | A1 | 5/2007 | Goodwin |
| 2008/0040832 | A1 | 2/2008 | Bay |
| 2008/0263743 | A1 | 10/2008 | Maurer |
| 2009/0077710 | A1 | 3/2009 | Bay |
| 2009/0144844 | A1 | 6/2009 | Dorr |
| 2009/0144884 | A1 | 6/2009 | Duncan |
| 2010/0043116 | A1 | 2/2010 | Vereen |
| 2011/0119811 | A1 | 5/2011 | Rock et al. |
| 2011/0131704 | A1 | 6/2011 | Hughes |
| 2011/0185482 | A1 | 8/2011 | Godfrey et al. |
| 2011/0225699 | A1 | 9/2011 | Elhamsadat et al. |
| 2011/0239350 | A1 | 10/2011 | Ho et al. |
| 2011/0265242 | A1 | 11/2011 | Lambertz |
| 2011/0296580 | A1 | 12/2011 | Demarest et al. |
| 2012/0114883 | A1 | 5/2012 | Kapur et al. |
| 2012/0174291 | A1 | 7/2012 | Fraze |
| 2012/0178343 | A1 | 7/2012 | Hurd et al. |
| 2012/0210499 | A1 | 8/2012 | Habash et al. |
| 2012/0233738 | A1 | 9/2012 | Blauer et al. |
| 2012/0276332 | A1 | 11/2012 | Conolly et al. |
| 2013/0230688 | A1 | 9/2013 | Wu |
| 2013/0269082 | A1 | 10/2013 | Bramblet |
| 2014/0004295 | A1 | 1/2014 | Kiederle |
| 2014/0007314 | A1 | 1/2014 | Davis et al. |
| 2014/0059736 | A1 | 3/2014 | Mccuaig |
| 2014/0087104 | A1 | 3/2014 | Kierderle et al. |
| 2014/0090144 | A1 | 4/2014 | Gilreath |
| 2014/0157482 | A1 | 6/2014 | Blauer et al. |
| 2014/0189935 | A1 | 7/2014 | Tucker |
| 2014/0250565 | A1 | 9/2014 | Willows et al. |
| 2014/0259268 | A1 | 9/2014 | Fier |
| 2014/0259276 | A1 | 9/2014 | Fier |
| 2014/0304896 | A1 | 10/2014 | Nordstrom et al. |
| 2014/0338092 | A1 | 11/2014 | Kinsey |
| 2014/0373248 | A1 | 12/2014 | Demarest et al. |
| 2015/0033451 | A1 | 2/2015 | Bradshaw |
| 2015/0104604 | A1 | 4/2015 | Rock et al. |
| 2015/0106992 | A1 | 4/2015 | Blakely et al. |
| 2015/0351458 | A1 | 12/2015 | Fisher et al. |
| 2016/0242469 | A1 | 8/2016 | Horner et al. |
| 2016/0242474 | A1 | 8/2016 | Baschak et al. |
| 2016/0302502 | A1 | 10/2016 | Beneyto-Ferre |
| 2017/0119073 | A1 | 5/2017 | Horner et al. |
| 2017/0215501 | A1 | 8/2017 | Horner et al. |
| 2019/0335829 | A1 | 11/2019 | Horner et al. |
| 2019/0380407 | A1 | 12/2019 | Horner et al. |
| 2020/0237038 | A1 | 7/2020 | Horner et al. |
| 2022/0211131 | A1 | 7/2022 | Horner et al. |
| 2023/0107724 | A1 | 4/2023 | Horner et al. |

FOREIGN PATENT DOCUMENTS

| | | | |
|---|---|---|---|
| FR | 2784868 | A1 | 4/2000 |
| FR | 2820000 | A1 | 8/2002 |
| JP | 61-199517 | U | 12/1986 |
| JP | 02-131515 | U | 11/1990 |
| JP | 2003-293205 | A | 10/2003 |
| JP | 3134972 | U | 8/2007 |
| JP | 2011-117121 | A | 6/2011 |
| JP | 2012-255242 | A | 12/2012 |
| JP | 2013-122095 | A | 6/2013 |
| KR | 10-2004-0093414 | A | 11/2004 |
| WO | 98/07340 | A1 | 2/1998 |
| WO | 99/05926 | A1 | 2/1999 |
| WO | 2005/112677 | A2 | 12/2005 |
| WO | 2010/091880 | A1 | 8/2010 |
| WO | 2012/085454 | A1 | 6/2012 |
| WO | 2012/136962 | A1 | 10/2012 |
| WO | 2013/171477 | A1 | 11/2013 |
| WO | 2015/034722 | A1 | 3/2015 |
| WO | 2015/131913 | A1 | 9/2015 |
| WO | 2016/134159 | A1 | 8/2016 |
| WO | 2018/132630 | A1 | 7/2018 |

OTHER PUBLICATIONS

"What I'm Riding: Rapha Winter Jersey," Cycle Boredom, cycleboredom.com, Apr. 26, 2012. http://www.cycleboredom.com/what-im-riding-rapha-winter-jersey/.

"X-Bionic: Patriot Energy Accumulator Ski Shirt," Luisaviaroma, luisaviaroma.com, Accessed: Jul. 2015. http://www.luisaviaroma.com/index.aspx?#ItemSrv.ashx| SeasonId=60I&CollectionId=DM1&ItemId=1&VendorColorId=VDAxOA2&SeasonMemoCode=actual&GenderMemoCode=men&Language=&CountryId=&SubLineMemoCode=clothing&CategoryId=0&ItemResponse=&MenuResponse=&SizeChart=false&ItemTag=true&NoContext=false.

"Arcteryx M Gamma LT Jacket Mens lightweight elastic softshell jacket," Product No. AXH10264, Outdoor Sports 24, outdoorsports24.com, Accessed Aug. 2015. http://www.outdoorsports24.com/Yoursports/Climbing/ClothingMen/ArcteryxMGAMMALTJACKETMenslightweightelasticsoftshelljacket310438.html.

"C8 Jersey Specifications," Dye, creativesrg.com, Accessed: Jul. 2015. http://www.creativesrg.com/demos/dye/C8Jerseys/specs.html.

"Fuse Jersey," Bellwether Cyclewear (registered), bellwetherclothing.com, Accessed: Jul. 2015. http://www.bellwetherclothing.com/mens/jerseysandtops/fuse/.

"Men's Quantum Short-Sleeve T-Shirt," Eddie Bauer, eddiebauer.com, Accessed: Jul. 2015. http://www.eddiebauer.com/product/quantum-short-sleeve-t-shirt/12950204/_/A-ebSku_0290805100000060_12950204_catalog10002_en US?showProducts=111&backToCat=&previousPage=SRC&tab=&color=511.

"Rondoy Down Jacket: K Series," PHD, phdesigns.co.uk, Accessed: Jul. 2015. http://www.phdesigns.co.uk/rondoy-down-jacket-k-series.

"Stone Island Marina Heat Reactive Jacket," End, endclothing.com, (copyright) 2015 Ashworth and Parker Ltd., accessed: Aug. 2015. http://www.endclothing.com/us/stoneislandmarinaheatreactivejacket.html.

Notice of Allowance received for U.S. Appl. No. 18/520,120, mailed on Mar. 13, 2025, 13 pages.

Office Action received for European Application No. 23217877.2, mailed on Apr. 23, 2025, 5 pages.

"Cyclic Zip Neck Women's," Arc'Teryx, arcteryx, (copyright) 2015, accessed: Aug. 2015. http://arcteryx.com/product.aspx?language=EN&gender=womens&category=shirts_and_tops&model=Cyclic-Zip-Neck-W.

"Trans4m (trademark) Thermal Plus (trademark) Run Glove," Amphipod, Inc., amphipod.com, (copyright) 2015, accessed: Aug. 2015. http://www.amphipod.com/products/trans4m-thermal-plus-run-glove.

Allen, Dana, "Mountain Equipment Eclipse Hooded Zip Tee", blister, blistergearreview.com, Available on Internet at: <http://blistergearreview.com/gear-reviews/mountain-equipment-eclipse-hooded-zip-tee>, Oct. 4, 2013, 3 pages.

Debra, Kitsilano, "Lululemon Pumpkin Orange Long Sleeve Turkey Trot Technical Running Shirt Top 205", goodoldlululemon.wordpress.com, Available on Internet at: <hllps://goodoldlululemon.wordpress.com/2013/02/08/ululemon-pumpkin---orange-long-sleeve-turkey-trot-technical-running- shirt-top-205/>, Feb. 8, 2013, 8 pages.

Johnson, J_ J., "Ortovox Merino Fleece Hoody", YMMV Reviews, Available on Internet at: <http://ymmvreviews.com/ clothing/ortovox-merino-fleece-hoody/>, Accessed on Aug. 9, 2015, 7 pages.

(56) References Cited

OTHER PUBLICATIONS

Office Action received for European Application No. 23217877.2, mailed on Jan. 13, 2026, 6 pages.

* cited by examiner

LAYERED THUMBHOLE STRUCTURE

CROSS-REFERENCE TO RELATED APPLICATIONS

This application entitled "Layered Thumbhole Structure," is a continuation application of U.S. Nonprovisional application Ser. No. 18/243,237, filed Sep. 7, 2023, and entitled "Layered Thumbhole Structure." The '237 application is a continuation application of U.S. Nonprovisional application Ser. No. 18/076,720, filed Dec. 7, 2022, and entitled "Layered Thumbhole Structure," which issued on Jul. 23, 2024 as U.S. Pat. No. 12,041,993. The '720 application is a continuation application of U.S. Nonprovisional application Ser. No. 16/552,676, filed Aug. 27, 2019, and entitled "Layered Thumbhole Structure," which issued on Jan. 3, 2023 as U.S. Pat. No. 11,540,571. The '676 application is a continuation-in-part application of U.S. Nonprovisional application Ser. No. 15/493,468, filed Apr. 21, 2017, and entitled "Layered Thumbhole Structure," which issued on Aug. 20, 2019 as U.S. Pat. No. 10,383,382. The '468 application is a continuation application of U.S. Nonprovisional application Ser. No. 15/045,465, filed Feb. 17, 2016, and entitled "Layered Thumbhole Structure," which issued on Jun. 20, 2017 as U.S. Pat. No. 9,681,689. The '465 application claims priority to U.S. Provisional Application No. 62/118,288, filed Feb. 19, 2015, and entitled "Adaptive Material Garment System," and further claims priority to U.S. Provisional Application No. 62/242,760, filed Oct. 16, 2015, and entitled "Layered Thumbhole Structure." The entireties of the aforementioned applications are incorporated by reference herein.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects described herein are directed towards a sleeve cuff having a thumbhole aperture formed between overlapping panels that can block, among other things, undesirable air flow into a sleeve when the aperture is not in use. The sleeve cuff is comprised of a distal panel (also referred to below as a distal strap) overlapping an anterior panel (also referred to below as an anterior patch). In an exemplary configuration, the distal panel and the anterior panel are affixed to a sleeve adjacent to, and covering at least a portion of, a cutout formed in the sleeve. The distal panel can span across the cutout and extend from a front edge (also referred to below as a leading edge) aligned with the end of the sleeve proximally up the sleeve to a back edge (also referred to below as a trailing edge). The anterior panel can be configured to cover at least a portion of the cutout. The anterior panel can include a back edge (also referred to as a trailing edge) and extend down the sleeve to a front edge (also referred to as a leading edge). For relational purposes, it is contemplated that the distal panel is affixed farther down the sleeve than the anterior panel.

It is contemplated that the configuration of the distal panel and the anterior panel can change, depending on whether the aperture is in an opened configuration (e.g., due to insertion of a thumb) or in a closed configuration, as will be described herein in more detail. In a closed configuration, the distal panel overlaps a portion of the anterior panel such that the distal panel back edge is located proximally up the sleeve from the anterior panel front edge. It is contemplated that either the anterior panel or the distal panel may be on top of the other at the overlapping portion. When in the closed configuration, permeability to the elements can be dramatically reduced. When in an opened configuration, the distal panel back edge overlaps a portion of the anterior panel (moving laterally across the anterior panel) between a first anterior panel side edge and a first point of intersection, and between a second anterior panel side edge and a second point of intersection. The first and second points of intersection refer to the intersections between the anterior panel front edge and the distal panel back edge. It is this offset design that provides a snug fit around a thumb that reduces air and environmental permeability when a thumb is received. In this open configuration, the anterior panel front edge is separated from the distal panel back edge and the aperture forms a snug fit around a received thumb between the first point of intersection and the second point of intersection. The perimeter of the aperture comprises a portion of the anterior panel front edge and a portion of the distal panel back edge.

Aspects described herein may further relate to a method of manufacturing a sleeve having a sleeve cuff in accordance with aspects described herein. In an exemplary aspect, the method may comprise the steps of providing a sleeve, providing an anterior panel, and providing a distal panel. The sleeve has a first end distally located from a torso end and having a hand opening thereat. The sleeve further comprises a cutout formed in a wall of the sleeve. In one aspect, the cutout has one or more edges. The distal panel has a back edge and at least one front edge. The anterior panel has a front edge and one or more back edges. The method further comprises the step of affixing the distal panel to the sleeve such that the distal strap spans the cutout. In one aspect, a distal panel front edge is aligned with the end of the sleeve. The method further comprises the step of affixing the anterior panel to the sleeve at the one or more back edges such that the anterior panel covers at least a portion of the cutout in the sleeve and such that the distal panel back edge overlaps at least a portion of the anterior panel. The overlapping distal panel and anterior panel present an aperture. The aperture has a perimeter comprised of at least a portion of the distal panel and at least a portion of the anterior panel. The method may further comprise the step of forming a cutout in the sleeve.

BRIEF DESCRIPTION OF THE DRAWINGS

Examples of the present invention are described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed, unless and except when the order of individual steps is explicitly stated.

The terms of location used in this disclosure related to a sleeve extending from a torso portion of an article of apparel shall have their traditional meanings. A point on the sleeve is proximal to a second point if it is farther up the sleeve (e.g., closer to the torso portion) in the axial direction of sleeve extension. A point on the sleeve is distal to a second point if it is farther down the sleeve (e.g., farther from the torso portion) in the axial direction of sleeve extension. The location term "lateral" as used in connection with the sleeve may include a planar direction normal to the axial direction of sleeve extension.

The terms "overlap," "overlaps," or "overlapping" (etc.) when used in this disclosure (e.g., "the distal strap overlaps the anterior patch") include both overlapping "on top of" and "beneath." In terms of the example, the distal strap may overlap the anterior patch such that the distal strap overlaps on top of the anterior patch or the distal strap may overlap the anterior patch such that the distal strap overlaps beneath the anterior patch.

Figure 1:
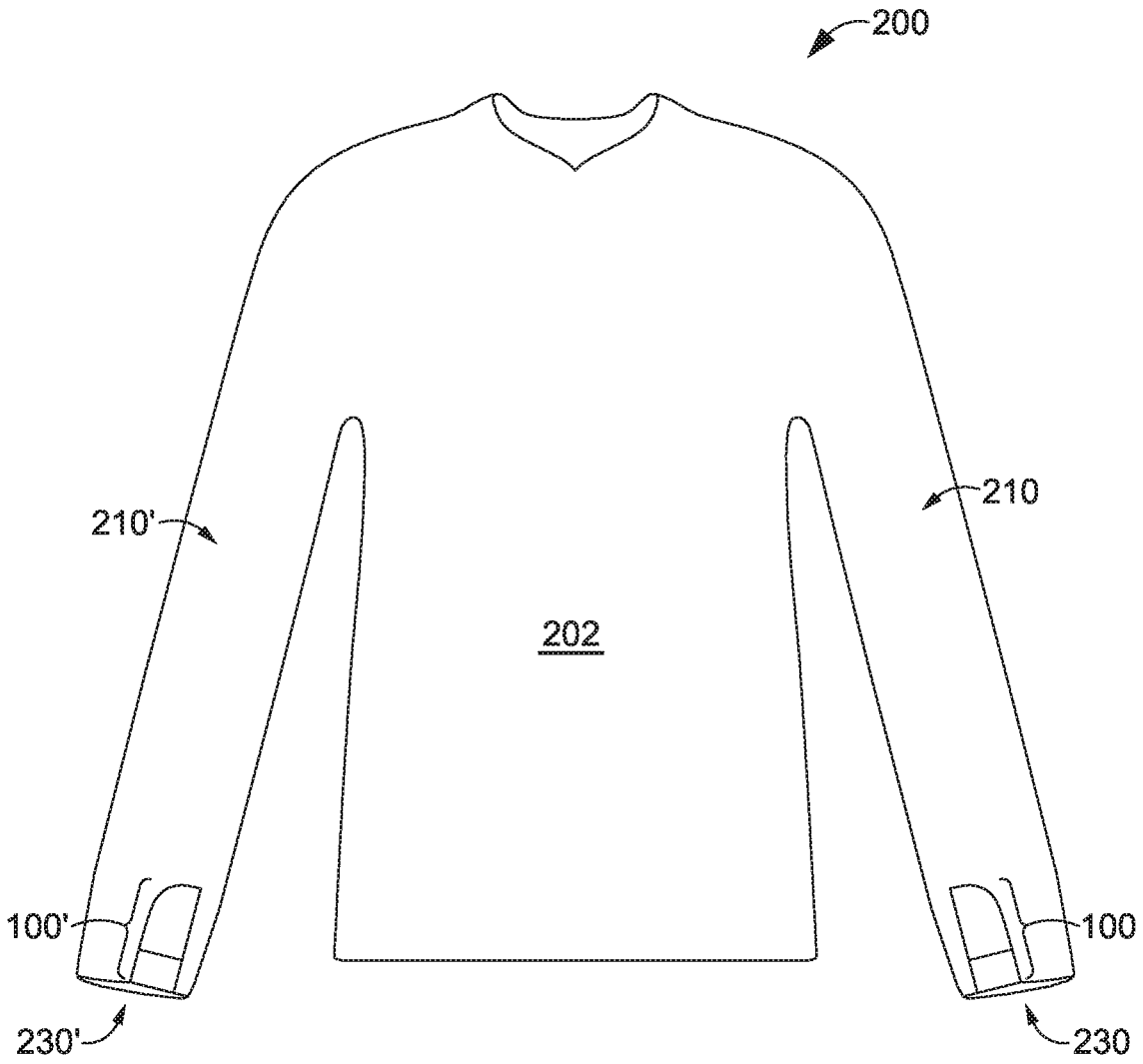
FIG. 1 illustrates a front elevation view of an exemplary article of apparel having sleeve cuffs affixed to distal sleeve ends on the article in accordance with an aspect described herein.

Turning now to FIG. 1, illustrated is a shirt 200 having a torso portion 202, a left sleeve 210, a right sleeve 210', each of the sleeves 210 and 210' extending distally away from the torso portion 202 each sleeve includes a proximal end attached to the torso portion 202 and terminating at distal sleeve ends 230 and 230', respectively, wherein for each sleeve, the proximal end is located longitudinally opposite form the distal end. Each sleeve may include a sleeve cuff 100 and 100', respectively, as depicted in FIG. 1. It is to be understood that the remaining disclosure describes the sleeve cuff 100 in relation to the left sleeve 210 and the distal sleeve end 230. As understood by those having skill in the art, however, this disclosure equally applies to the sleeve cuff 100' in relation to the right sleeve 210' and the distal sleeve end 230'. The remainder of this disclosure shall reference a sleeve 210.

Figure 2A:
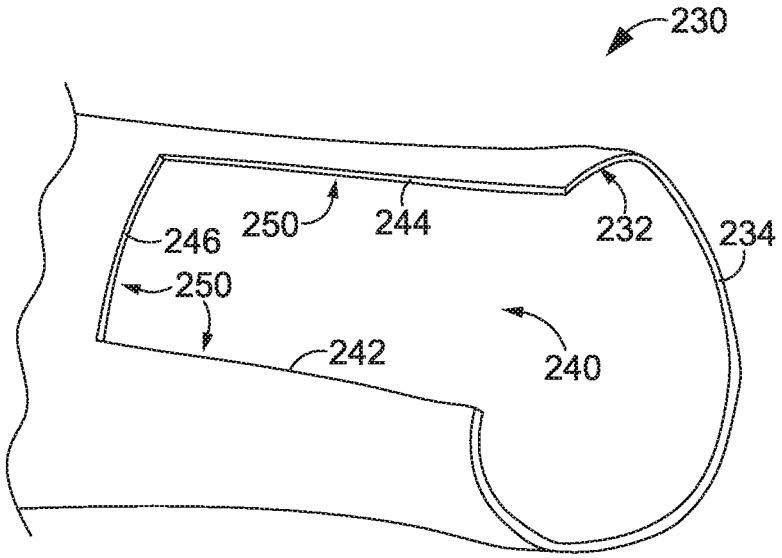
FIG. 2A illustrates a detail view of a distal sleeve end without a sleeve cuff affixed thereto in accordance with an aspect described herein.
Figure 2B:
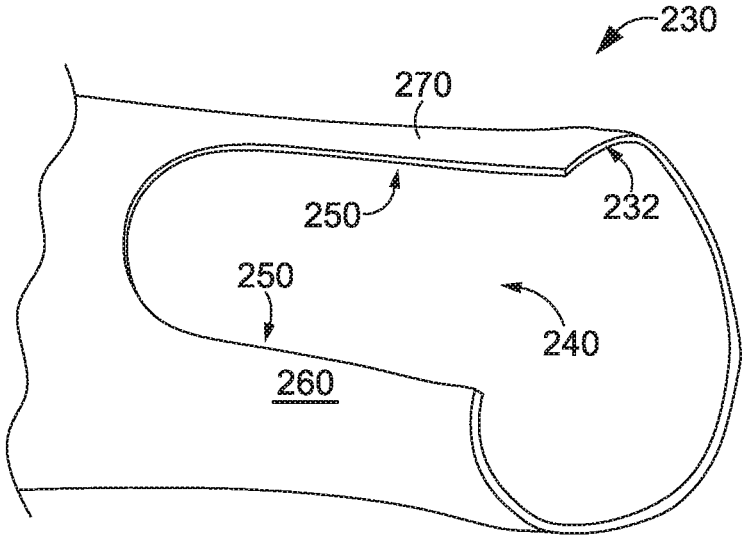
FIG. 2B illustrates a detail view of an alternative distal sleeve end without a sleeve cuff affixed thereto in accordance with an aspect described herein.

FIG. 2A depicts a distal sleeve end 230 of the sleeve 210 without the sleeve cuff 100 affixed thereto. The distal sleeve end 230 comprises a sleeve wall 232 extending proximally up the sleeve from a distal edge 234. The sleeve wall 232 includes a cutout 240 formed therein. The cutout 240 may extend from the distal edge 234 proximally up the sleeve 210. The cutout 240 further comprises at least one cutout edge 250. The at least one cutout edge 250 may comprise a first cutout edge 242, a second cutout edge 244, and a rear cutout edge 246 as depicted in FIG. 2A. The distal sleeve end 230 further comprises a first outer surface 260 and a second outer surface 270 (as illustrated in FIG. 2B), each outer surface being located adjacent to the cutout 240. In some aspects, the first cutout edge 242, the second cutout edge 244, and the rear cutout edge 246 may be a single edge comprising the at least one cutout edge 250.

In another aspect, the cutout 240 may be formed proximally up the sleeve 210 from the distal edge 234. In this aspect, the cutout 240 comprises a hole formed in the sleeve wall 232 and the cutout 240 is bounded by the sleeve wall 232 on all sides. In this aspect, the at least one cutout edge 250 may further comprise a front cutout edge. The front cutout edge and the distal edge 234 form a margin at the distal sleeve end 230.

In another aspect illustrated in FIG. 2B, the distal sleeve end 230 includes a cutout 240 formed in a sleeve wall 232. The cutout 240 extends proximally up the sleeve 210 and includes the at least one cutout edge 250. Spaced apart by the cutout 240 are the first outer surface 260 and the second outer surface 270.

Figure 3:
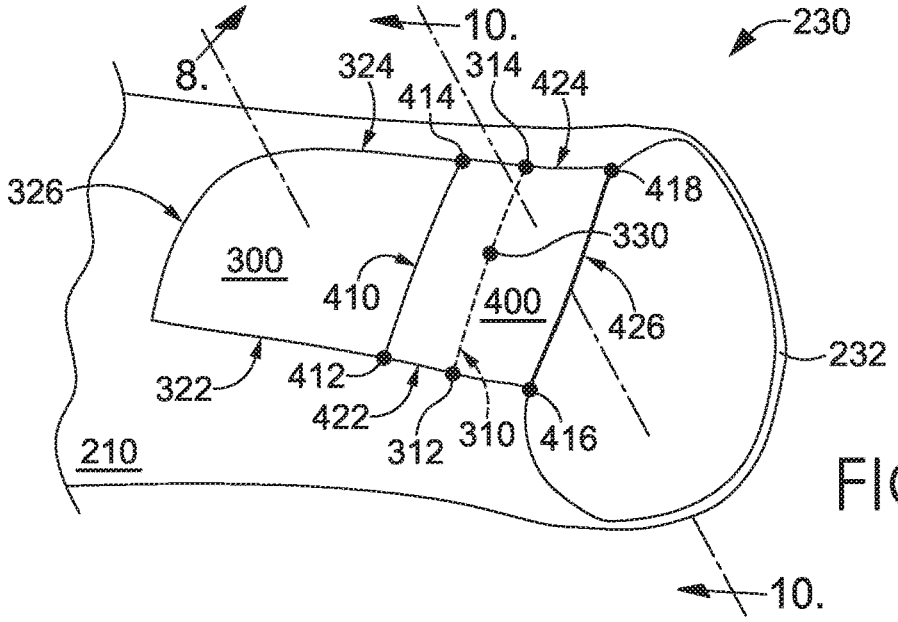
FIG. 3 illustrates a detail view of a sleeve cuff in a closed configuration in accordance with an aspect described herein.
Figure 4:
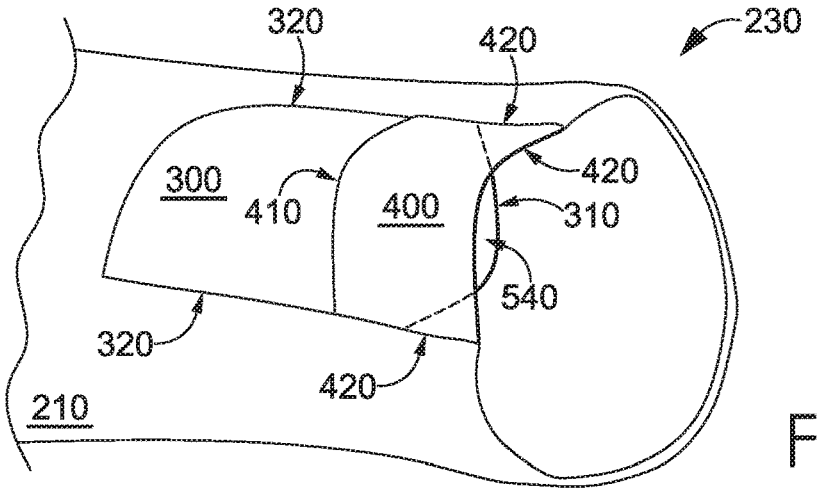
FIG. 4 illustrates a detail view of a sleeve cuff with a distal strap and an anterior patch separated while in the closed configuration in accordance with an aspect described herein.
Figure 5:
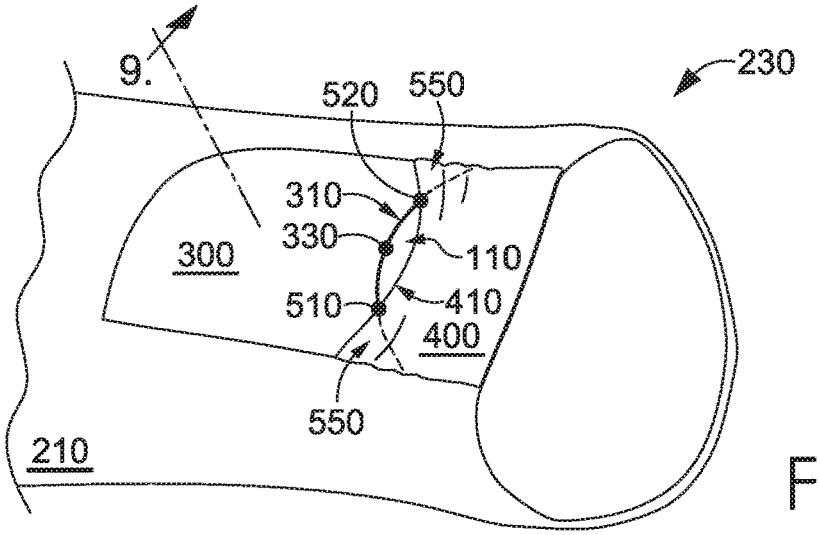
FIG. 5 illustrates a detail view of a sleeve cuff in an opened configuration in accordance with an aspect described herein.

Referring now to FIGS. 3-5, the sleeve cuff 100 further comprises an anterior patch 300 affixed to the sleeve 210. The anterior patch 300 is shown having a leading edge 310 and a plurality of trailing edges 320. In another aspect, the anterior patch 300 may have a leading edge 310 and a single trailing edge extending from one side to the other side of the leading edge 310, the anterior patch 300 extending there-between. The leading edge 310 extends laterally across the cutout 240 from a first anchor point 312 associated with the first outer surface 260 to a second anchor point 314 associated with the second outer surface 270. In another aspect, the leading edge 310 may extend between a first anchor point 312 associated with a first cutout edge 242 to a second anchor point 314 associated with a second cutout edge 244. The anterior patch leading edge 310 is spaced away from the distal end of the sleeve in a direction toward the proximal end of the sleeve. The plurality of trailing edges 320 are located proximally up the sleeve from the leading edge 310, and the anterior patch 300 extends there-between. In the aspect illustrated by FIG. 3, the plurality of trailing edges includes a first side edge 322, a second side edge 324, and a rearward edge 326.

The anterior patch 300 may be affixed to the sleeve 210 atop or below the sleeve wall 232, within the cutout 240 to the at least one cutout edge 250 or in combination thereof. In another aspect, at least one first seam may affix the anterior patch 300 to the sleeve 210. In one aspect, the anterior patch 300 is affixed to the sleeve 210 from the first anchor point 312 around the cutout 240 located proximally to the leading edge 310 at each of the plurality of trailing edges 320 and to the second anchor point 314. In the aspect illustrated by FIG. 3, the anterior patch 300 is affixed adjacent to the rear cutout edge 246 at the rearward edge 326. As further illustrated in FIG. 3, the anterior patch 300 extends distally down the sleeve 210 from the rearward edge 326 to the leading edge 310 and the first and second side edges 322 and 324 are affixed adjacent to the first and second cutout edges 242 and 244, respectively, from the rearward edge 326 to the first and second anchor points 312 and 314, respectively. In one aspect, the anterior patch 300 may cover at least a portion of the cutout 240. The term "cover" is not meant to imply a limitation that the anterior patch 300 must be atop the sleeve 210; to the contrary, the anterior patch 300 may be atop or below the sleeve 210 or within the cutout 240 and prevent communication through the portion of the cutout 240 that is "covered."

The sleeve cuff 100 further comprises a distal strap 400. In one aspect, the distal strap 400 includes a trailing edge 410 and a plurality of leading edges 420 and extends there-between. In another aspect, the distal strap 400 may include a trailing edge 410 and a single leading edge. In the aspect illustrated in FIG. 3, the plurality of leading edges 420 include a first side edge 422, a second side edge 424, and a front edge 426, the front edge 426 being parallel to the trailing edge 410. In one aspect, the trailing edge 410 extends across the cutout 240 from a first anchor point 412 to a second anchor point 414. In the aspect depicted in FIG. 3, the front edge 426 extends laterally across the cutout 240 from a third anchor point 416 to a fourth anchor point 418. In any aspect depicted in FIG. 3, the distal strap 400 spans the cutout 240 and is affixed to the sleeve 210 such that the first side edge 422 is affixed to the first outer surface 260 and the second side edge 424 is affixed to the second outer surface 270. The distal strap 400 may be oriented to have a long length dimension extend laterally around the sleeve and a short width dimension extend axially up the sleeve. In the aspect illustrated in FIG. 3, the front edge 426 is not affixed to the sleeve 210. In this aspect, the front edge 426 may be laterally aligned with the distal edge 234. In another aspect, where the cutout 240 may be spaced proximally up the sleeve 210 from the distal edge 234, the front edge 426 may be affixed to the sleeve 210 adjacent to the forward cutout edge.

The exemplary distal strap 400 illustrated in FIG. 3 extends laterally across the cutout 240 between the first side edge 422 and the second side edge 424 and proximally up the sleeve 210 from the front edge 426 to the trailing edge 410. In the illustrated aspect, the sleeve cuff 100 is in a closed configuration and the distal strap trailing edge 410 is proximally located up the sleeve from the anterior patch leading edge 310; stated another way, the distal strap 400 overlaps the anterior patch 300.

The distal strap 400 may be affixed atop the sleeve 210, below the sleeve 210, within the cutout 240, or in some combination thereof. In one aspect, the distal strap 400 is affixed to the distal sleeve end 230 at the first outer surface 260 and the second outer surface 270. In another aspect, the at least one first seam may affix the distal strap 400 to the sleeve 210. In yet another aspect, a second seam may affix the distal strap 400 to the sleeve 210. In one aspect, the distal strap 400 is affixed to the sleeve 210 along the first side edge 422 from the first anchor point 412 to the third anchor point 416 and along the second side edge 424 from the second anchor point 414 to the fourth anchor point 418.

When the shirt 200 is in the as-worn position (i.e., when the shirt 200 is donned by a wearer), the sleeve cuff 100 presents a plurality of configurations. In one aspect, the plurality of configurations includes at least the closed configuration and an opened configuration. The closed configuration is best seen in FIG. 3. The opened configuration may be seen in FIGS. 6-8. In one aspect, the closed configuration is defined by the distal strap 400 overlapping the anterior patch 300 such that the distal strap trailing edge 410 is located proximally up the sleeve 210 from the anterior patch leading edge 310. The closed configuration is typically presented when the sleeve is in the as-worn position and a thumb is not received through the aperture 110.

One aspect of the open configuration illustrated in FIG. 5 includes the aperture 110 presented between a first point of intersection 510 and a second point of intersection 520. The points of intersection 510 and 520 are defined by the points where the distal strap trailing edge 410 intersects the anterior patch leading edge 310.

In the aspect illustrated in FIG. 5, when the sleeve cuff 100 is in the open configuration, the sleeve cuff 100 may include an overlapping portion 550 where the distal strap 400 overlaps the anterior patch 300 between the first cutout edge 242 and the first point of intersection 510. The sleeve cuff 100 in the open configuration further includes the aperture 110 between the first point of intersection 510 and the second point of intersection 520. In one aspect, a perimeter of the aperture 110 is comprised of a portion of the distal strap trailing edge 410 and a portion of the anterior patch leading edge 310. The sleeve cuff 100 in the open configuration may further include a second overlapping portion where the distal strap 400 overlaps the anterior patch 300 between the second point of intersection 520 and the second cutout edge 244.

FIG. 4 depicts the exemplary sleeve cuff 100 of FIG. 3 with the distal strap 400 and the anterior patch 300 separated while still in the closed configuration in accordance with an aspect hereof. As can be understood, the separation of the anterior patch 300 and distal strap 400 in the manner depicted in FIG. 4 does not provide a hole through which a user's thumb may extend as a thumb will extend along the inner surface of the anterior patch 300 past the trailing edge 410 of the distal strap 400 which prevents, based on traditional human anatomy, the thumb from accidentally extending through the aperture 110, in an exemplary aspect. Therefore, a gap 540 may be formed between the distal strap 400 and the anterior patch 300 without eliminating an overlap near the midpoint of the leading edge 310.

FIG. 5 depicts the sleeve cuff 100 in an open configuration at the aperture 110 in accordance with aspects described herein. In this example, a center point 330 is not overlapped by the distal strap 400. The leading edge 310 is overlapped by the distal strap 400 trailing edge 410 near the first and second side edges 322 and 324. However, the leading edge 310 intersects the trailing edge 410, at the first and second points of intersection 510 and 520, causing the center point 330 to be spaced apart from the distal strap 400 and to form the aperture 110. Stated differently, it is contemplated that the aperture 110 is defined by the leading edge 310 and the trailing edge 410 between a first point of intersection 510 and a second point of intersection 520 of the same edges. The perimeter of the aperture 110 may include at least a portion of the leading edge 310 and at least a portion of the trailing edge 410.

Figure 6:
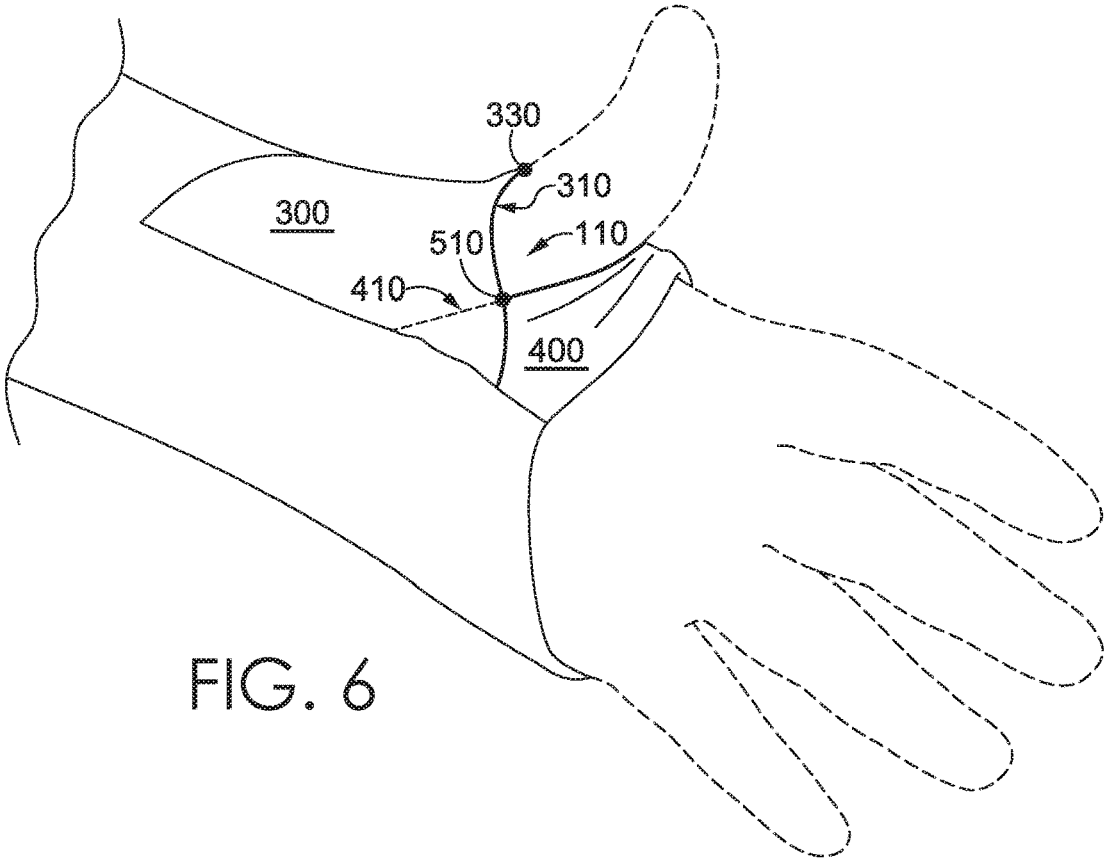
FIG. 6 illustrates a detail view of a sleeve cuff having a thumb extending through an aperture in accordance with an aspect described herein.

FIG. 6 illustrates an alternative aspect of the present invention where the anterior patch 300 overlaps the distal strap 400 on the exterior side of the sleeve 210 (from FIG. 3). Hence, when viewed from outside the sleeve 210, the anterior patch 300 is on top of the distal strap 400 where the items overlap.

Figure 7:
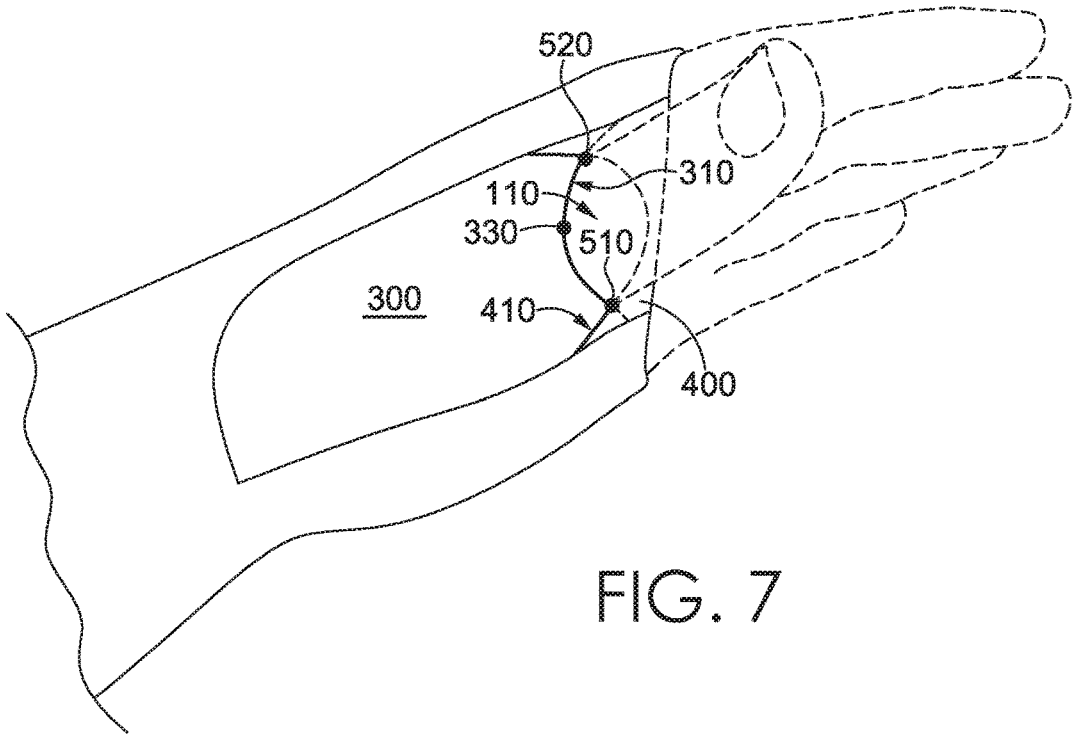
FIG. 7 illustrates a detail view of a sleeve cuff having a thumb extending through an aperture in accordance with an aspect described herein.

FIG. 6 and FIG. 7 depict the sleeve cuff 100 in the open configuration and having a thumb received through the aperture 110 in accordance with aspects described herein. As can be illustrated with a thumb extending therethrough, the aperture 110 is formed, in an exemplary aspect, by the leading edge 310 extending radially outward from an axial centerline of the sleeve 210 when in the open configuration. To facilitate transitioning from a closed to an open configuration, and to allow for freedom of movement of the thumb, it is contemplated that the distal strap 400 and/or the anterior patch 300 are formed from an elastic material that allows for the manipulation of the trailing edge 410 and the leading edge 310 to open and move about a thumb.

Varying the materials used to form the distal strap 400 and/or the anterior patch 300 may provide for additional control of the elasticity provided at the distal sleeve end 230. In one aspect, the distal strap 400 and/or the anterior patch 300 may be comprised of a woven material. In another aspect, the distal strap 400 and/or the anterior patch 300 may be comprised of an engineered knit material. In some aspects, the sleeve 210 can be comprised of materials having lower elasticity than the materials in the sleeve cuff 100. In those aspects, including the sleeve cuff 100 in the sleeve 210 allows the wearer to pull the sleeve 210 up their arm such that the distal sleeve end 230 is positioned proximally up the wearer's arm. Further, the net elasticity of the distal sleeve end 230 and the sleeve cuff 100 may be operable to hold the distal sleeve end 230 at the proximally located position of the wearer's arm.

Figure 8:
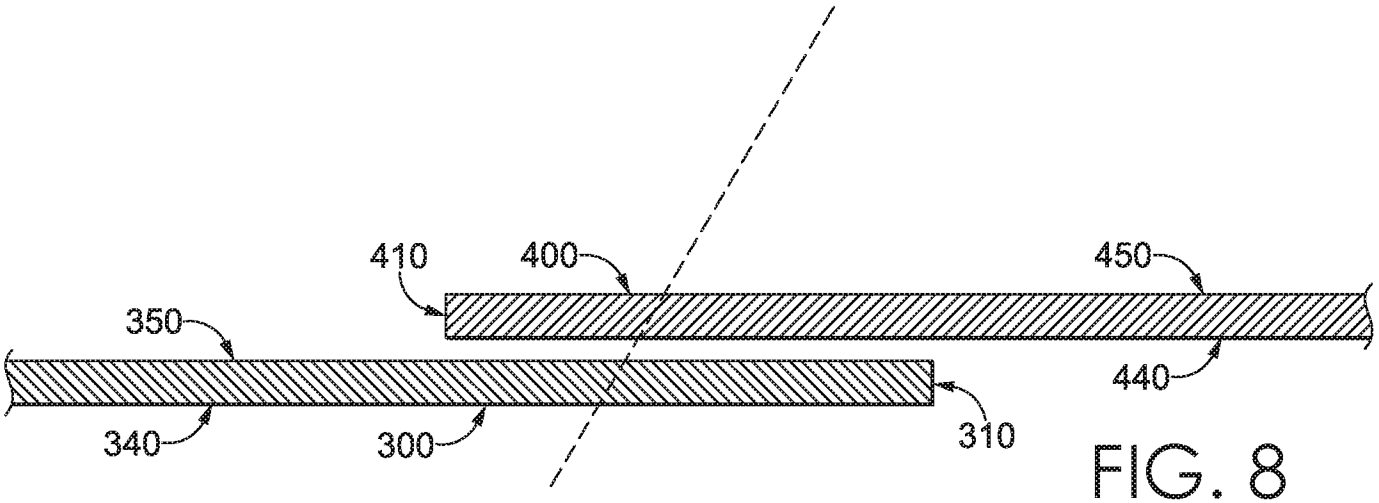
FIG. 8 depicts a cross-section taken along 8-8 of FIG. 3 and illustrates a sleeve cuff in a closed configuration in accordance with an aspect described herein.

FIG. 8 depicts a cross-section of a sleeve cuff 100 in a closed configuration, in accordance with aspects described herein. The distal strap 400 is comprised of an inner surface 440 and an outer surface 450. The anterior patch 300 is comprised of an inner surface 340 and an outer surface 350. As depicted, the distal strap 400 trailing edge 410 overlaps the anterior patch 300. A dash line is provided to depict an exemplary angle of thumb insertion to open the thumbhole by changing the relative placement of the trailing edge 410 relative to the leading edge 310 as depicted in FIG. 9.

Figure 9:
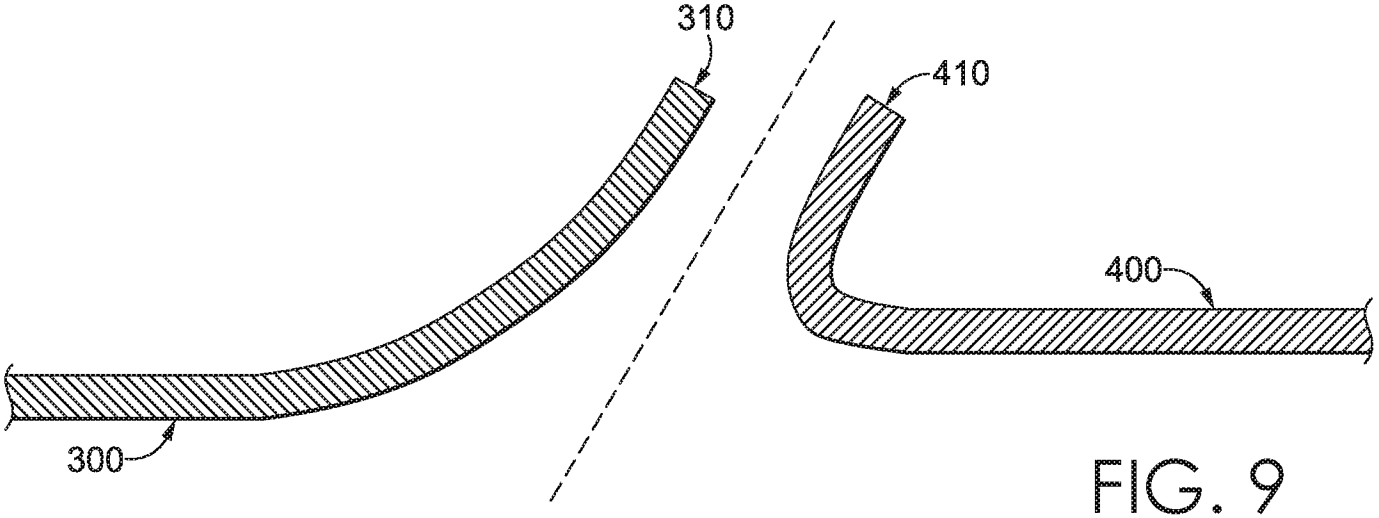
FIG. 9 depicts a cross-section taken along 9-9 of FIG. 5 and illustrates a sleeve cuff in an opened configuration in accordance with an aspect described herein.

FIG. 9 depicts a cross-section of the sleeve cuff 100 in the opened configuration, in accordance with aspects described herein. The open configuration allows a thumb having an angle of entry depicted by the dash line to exit an internal volume of the sleeve 210.

The sleeve cuff 100 has hereinabove been disclosed as having the distal strap 400 overlapping the anterior patch 300. It is contemplated, however, that in one exemplary aspect the anterior patch 300 overlaps the distal strap 400. In this aspect, the anterior patch leading edge 310 overlaps the distal strap and is distally located down the sleeve 210 from the distal strap trailing edge 410. This aspect further comprises the aperture 110 formed between the overlapping anterior patch 300 and distal strap 400 and having a perimeter including at least a portion of each of the leading edge 310 and the trailing edge 410.

Figure 10:
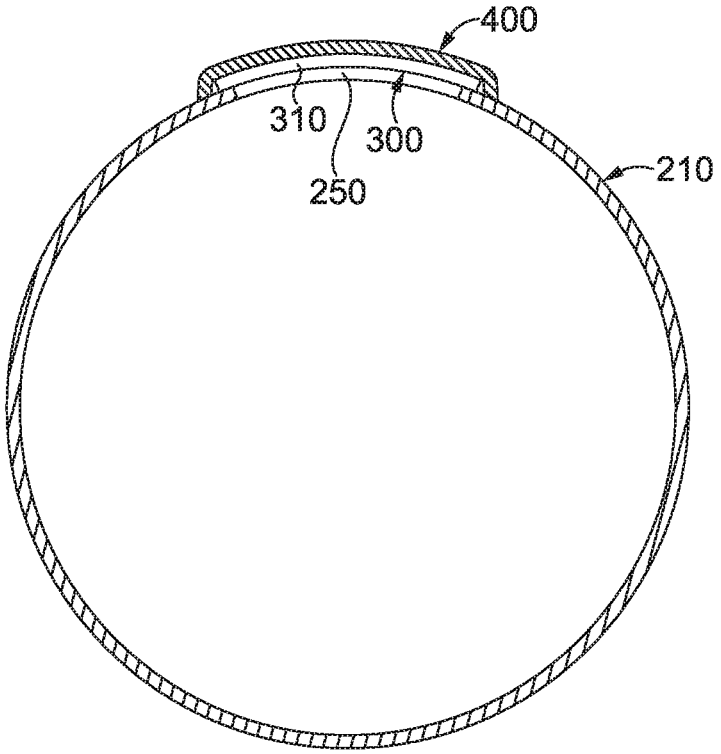
FIG. 10 depicts a cross-section taken along 10-10 of FIG. 3 and illustrates a sleeve cuff affixed to sleeve surfaces on opposite sides of a cutout and in a closed configuration in accordance with an aspect described herein.

FIG. 10 depicts a lateral cross-section of the sleeve cuff 100 across line 10-10 in FIG. 3, the line 10-10 being coplanar with the anterior patch leading edge 310. The distal strap 400 is shown overlapping the anterior patch 300 and the sleeve cuff 100 is in the closed configuration. It is understood that the anterior patch 300 is affixed at the inner surface 340 to the sleeve wall 232 at the first and second outer surfaces 260, 270. Further, it is understood that the distal strap 400 is similarly affixed at the distal strap inner surface 440 to the sleeve wall 232 at the first and second outer surfaces 260, 270.

Figure 11:
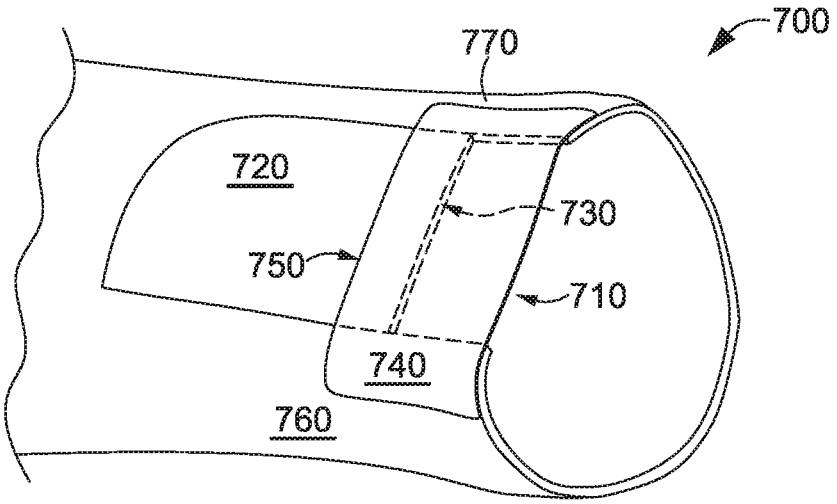
FIG. 11 illustrates a detail view of a sleeve cuff with a distal strap affixed to sleeve surfaces on opposite sides of a cutout and an anterior patch affixed within the cutout to opposing cutout edges and in a closed configuration in accordance with an aspect described herein.

FIG. 11 depicts another aspect of the distal sleeve end 700 in a closed configuration in accordance with an aspect hereof. Depicted is a distal sleeve end 700 having a cutout 710. The cutout 710 includes an anterior patch 720 affixed around and adjacent to the cutout 710 at the points proximally located up the sleeve from a leading edge 730. The distal sleeve end 700 further includes a distal strap 740 having a trailing edge 750, the distal strap 740 being affixed at a first sleeve surface 760 and a second sleeve surface 770. The trailing edge 750 is located proximally up the sleeve from the anterior patch leading edge 730. As depicted, the distal strap 740 is wider than the cutout 710 and is also wider than the anterior patch 720. In one aspect, the distal strap 740 is affixed to the sleeve on both sides of the cutout 710 but not at points adjacent to the cutout 710. In another aspect, the sleeve integrates the anterior patch 720 therein such that the leading edge 730 forms a rear wall of the cutout 710. In this aspect, the distal strap trailing edge 750 is proximally located up the sleeve from the integral leading edge 730. In yet another aspect, the distal strap 740 may be similarly integrated into the distal sleeve end 700 and the anterior patch 720 is affixed to the sleeve such that the integral trailing edge 750 overlaps the anterior patch leading edge 730.

Figure 12:
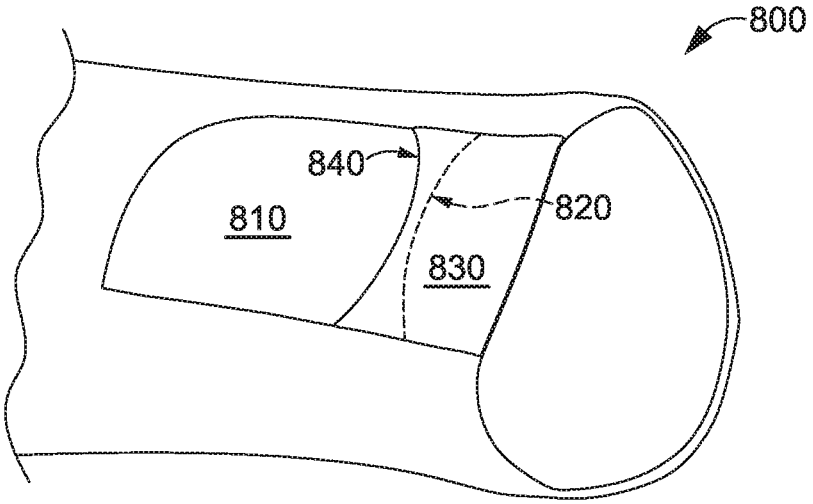
FIG. 12 illustrates a detail view of a sleeve cuff with an angular distal strap trailing edge and an angular anterior patch leading edge in accordance with an aspect described herein.

FIG. 12 depicts a distal sleeve end 800 in a closed configuration having an anterior patch 810 and a distal strap 830 affixed over a cutout. In one aspect, the distal strap 830 includes a trailing edge 840 having an arcuate shape. In this aspect, the anterior patch 810 has a leading edge 820 having an arcuate shape. The distal strap 830 may be positioned such that the distal strap 830 overlaps the anterior patch 810 and the arcuate trailing edge 840 is positioned proximally up the sleeve from the arcuate leading edge 820 and there are no points of intersection between the arcuate trailing edge 840 and the arcuate anterior leading edge 820.

Figure 13:
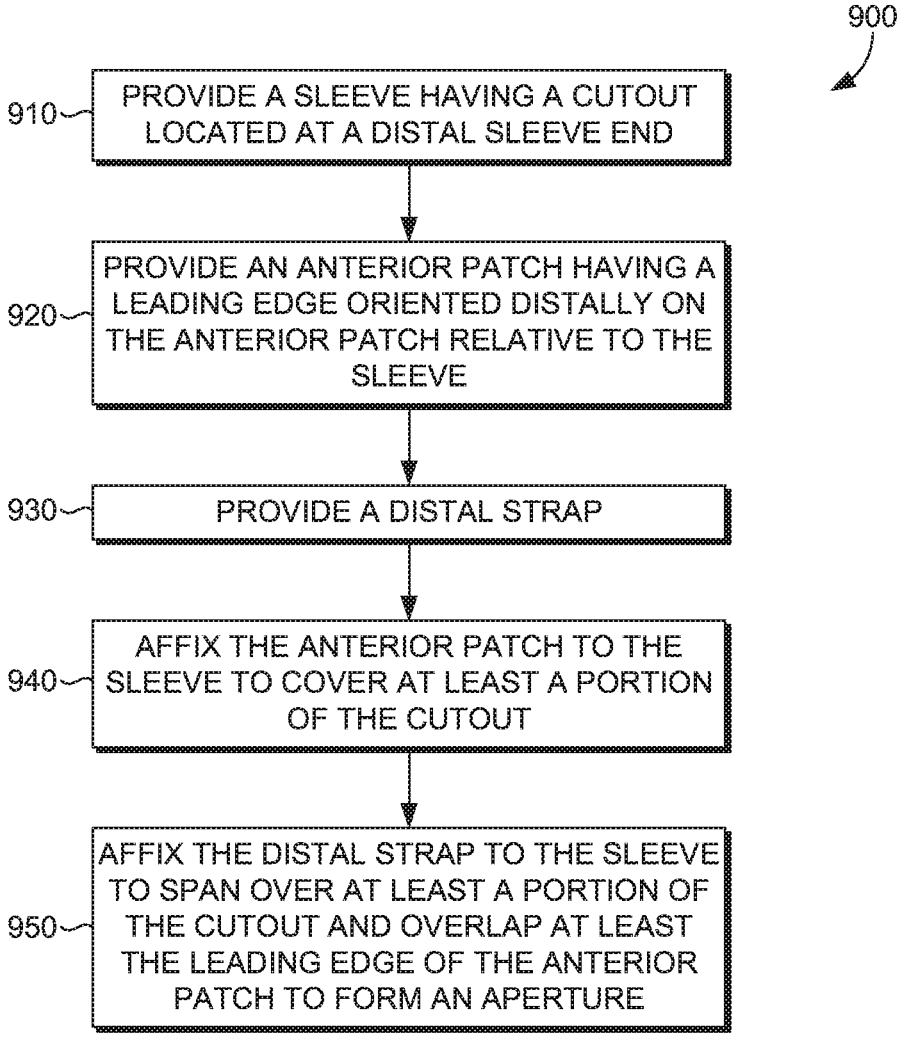
FIG. 13 depicts a flow diagram illustrating a method of manufacturing a sleeve having a sleeve cuff with an aperture for receiving a thumb, in accordance with an aspect described herein.

FIG. 13 depicts a method 900 of manufacturing a sleeve having a sleeve cuff for receiving a thumb through an aperture. Initially, the method 900 of manufacturing a sleeve 210 having a sleeve cuff 100 involves providing a sleeve 210, the sleeve 210 having a cutout 240 located at a distal sleeve end 230, as depicted at block 910. In one aspect, the distal sleeve end 230 is distally located from the wearer's torso when the sleeve is in an as-worn position, the distal sleeve end 230 presents a hand opening allowing a hand of the wearer to communicate through the interior of the sleeve, and the sleeve 210 further including a cutout 240 formed through a sleeve wall 232 of the sleeve, and the cutout 240 having at least one cutout edge 250.

The method 900 further comprises the step of providing an anterior patch 300 having a leading edge 310 oriented distally on the anterior patch 300 relative to the sleeve 210, as depicted in block 920. In one aspect, the anterior patch 300 includes a plurality of trailing edges 320. The plurality of trailing edges 320 on the anterior patch 300 are located proximally from the leading edge 310.

The method 900 further comprises the step of providing a distal strap 400, as depicted in block 930. In an exemplary aspect, the distal strap 400 includes a trailing edge 410 and a plurality of leading edges 420. The distal strap 400 is oriented relative to the sleeve 210 to have the trailing edge 410 located proximally from the plurality of leading edges 420.

The method 900 further comprises the step of affixing the anterior patch 300 to the sleeve 210 to cover at least a portion of the cutout 240, as depicted in block 940. In an aspect, the anterior patch 300 is affixed to the sleeve 210 at the plurality of trailing edges 320.

The method 900 further comprises the step of affixing the distal strap 400 to the sleeve 210 to span over at least a portion of the cutout 240 and overlap at least the leading edge 310 of the anterior patch 300 to form an aperture 110, as depicted in block 950. In an aspect, the distal strap 400 is affixed to the sleeve 210 at the plurality of leading edges 420. In an aspect, the plurality of leading edges 420 are affixed proximate to the distal sleeve end 230 and extend proximally up the sleeve 210 to the distal strap trailing edge 410.

Other aspects of a tubular sleeve will now be described in reference to FIGS. 14-20. The tubular sleeve described herein may related to a sleeve affixed to, or integral with, a garment (e.g., a shirt). The tubular sleeve described herein may also relate to a stand-alone garment (e.g., a sleeve configured to enclose at least a portion of an arm of a wearer).

Figure 14:
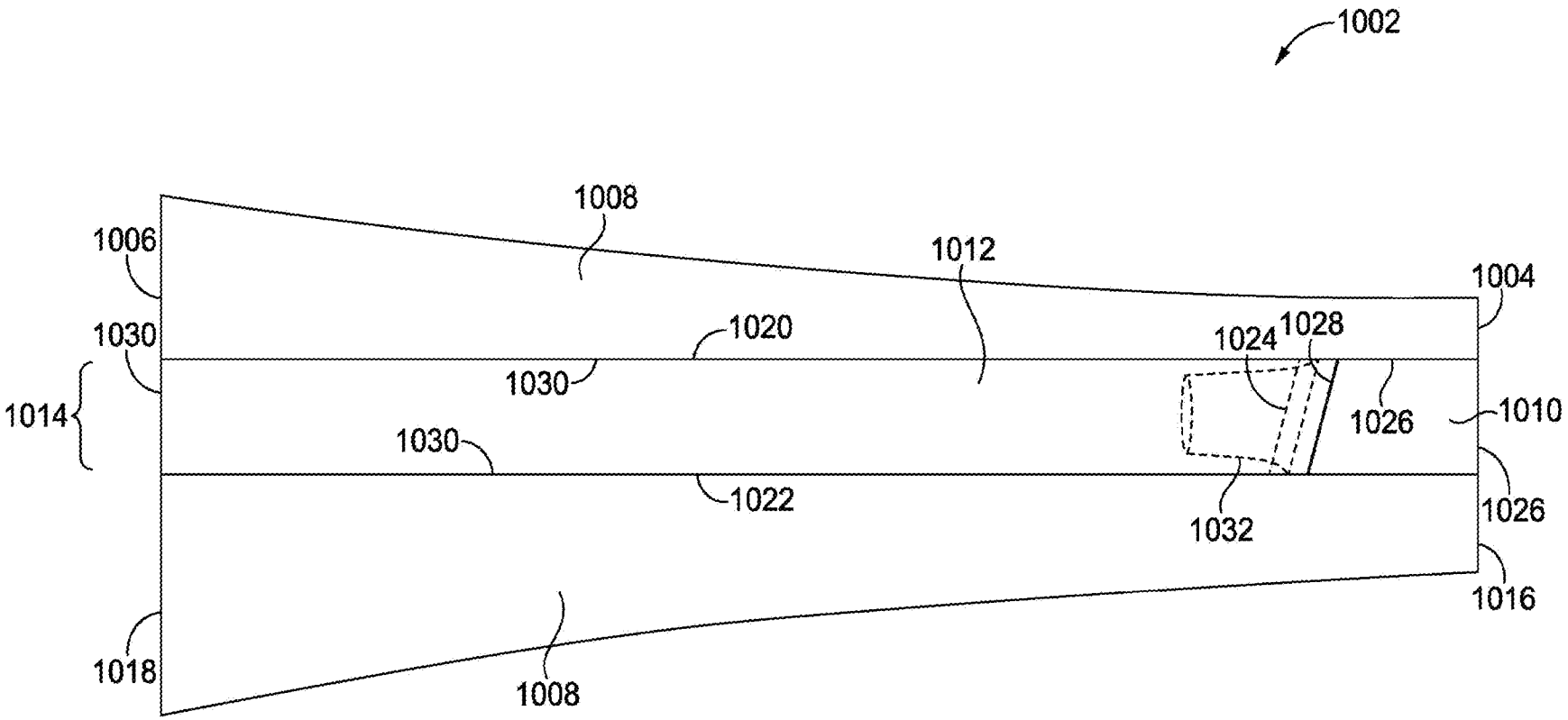
FIG. 14 illustrates a top view of a sleeve with a distal strap trailing edge and an anterior patch leading edge each extending at an angle to a distal end of the sleeve, in accordance with an aspect described herein.

The tubular sleeve illustrated in FIGS. 14-20 may be similar to the tubular sleeve illustrated in FIGS. 1-12. For example, as seen in FIG. 14, the tubular sleeve 1002 may have a distal end 1004 opposite a proximal end 1006 and be substantially defined by a sleeve wall 1008. The tubular sleeve 1002 may have a distal strap 1010 and an anterior patch 1012, both of which span laterally across a portion of a cutout 1014. Unlike the aspects discussed above, however, the cutout 1014 extends from the distal end 1004 to the proximal end 1006 of the tubular sleeve 1002.

In some aspects, the sleeve wall 1008 is formed from a panel of fabric. In these aspects, the panel of fabric may have a distal edge 1016 opposite a proximal edge 1018, a first longitudinal edge 1020, and a second longitudinal edge 1022. Continuing with these aspects, the cutout 1014 may extend between the first longitudinal edge 1020 and the second longitudinal edge 1022, where the first longitudinal edge 1020 is spaced apart from the second longitudinal edge 1022. Thus, the cutout 1014 need not actually be a portion removed from the sleeve wall 1008 but may comprise a gap extending proximally up the tubular sleeve 1002 across which the anterior patch 1012 and the distal strap 1010 extend. The following description of a tubular sleeve having a cylindrical sheath, however, also applies to the aspects shown in FIGS. 1-12.

The distal strap 1010 includes a distal strap trailing edge 1024 and one or more distal strap leading edges 1026. The distal strap trailing edge 1024 extends laterally across the cutout 1014. In some aspects, the distal strap 1010 is affixed to the tubular sleeve 1002 at the first longitudinal edge 1020 and the second longitudinal edge 1022 of the sleeve wall 1008. In other aspects, the distal strap 1010 may be coupled to an inner surface and/or an outer surface of the sleeve wall 1008 on opposing sides of the cutout 1014. In further aspects, the distal strap 1010 may be joined to the tubular sleeve 1002 at one or more seams.

The anterior patch 1012 includes an anterior patch leading edge 1028 and one or more anterior patch trailing edges 1030. The anterior patch leading edge 1028 extends laterally across the cutout 1014. In some aspects, the anterior patch 1012 is affixed to the tubular sleeve 1002 at the first longitudinal edge 1020 and the second longitudinal edge 1022 of the sleeve wall 1008 such that it spans the cutout 1014. In other aspects, the anterior patch 1012 may be coupled to an inner surface and/or an outer surface of the sleeve wall 1008 on opposing sides of the cutout 1014. In further aspects, the anterior patch 1012 may be joined to the tubular sleeve 1002 at one or more seams. The anterior patch 1012 illustrated in FIG. 14 extends proximally up the tubular sleeve 1002 from the anterior patch leading edge 1028 to the proximal end 1006 of the sleeve. In example aspects, the anterior patch 1012 completely covers a portion of the cutout 1014 located proximal to the anterior patch leading edge 1028.

The distal strap 1010 is coupled to the tubular sleeve 1002 such that the distal strap trailing edge 1024 continuously overlaps the anterior patch leading edge 1028 between the first longitudinal edge 1020 and the second longitudinal edge 1022. Thus, an opening is provided that permits communication from an interior portion of the tubular sleeve 1002 to an exterior of the tubular sleeve 1002. A perimeter defines the boundaries of the opening. In some aspects, the perimeter comprises the distal strap trailing edge 1024 and the anterior patch leading edge 1028. In other aspects, the perimeter comprises the distal strap trailing edge 1024, one or more of the one or more distal strap leading edges 1026, one or more of the one or more anterior patch trailing edges 1030, and/or the sleeve wall 1008.

In FIG. 14, the distal strap trailing edge 1024 and the anterior patch leading edge 1028 are shown extending in a non-parallel direction relative to the distal end 1004 of the tubular sleeve 1002. Further, the distal strap trailing edge 1024 and the anterior patch leading edge 1028 are shown extending in parallel to one another. In other aspects, one or more of the distal strap trailing edge 1024 and the anterior patch leading edge 1028 may extend in parallel to the distal end 1004 of the tubular sleeve 1002. And, in some aspects, the distal strap trailing edge 1024 and the anterior patch leading edge 1028 do not extend in parallel to one another.

Figure 15:
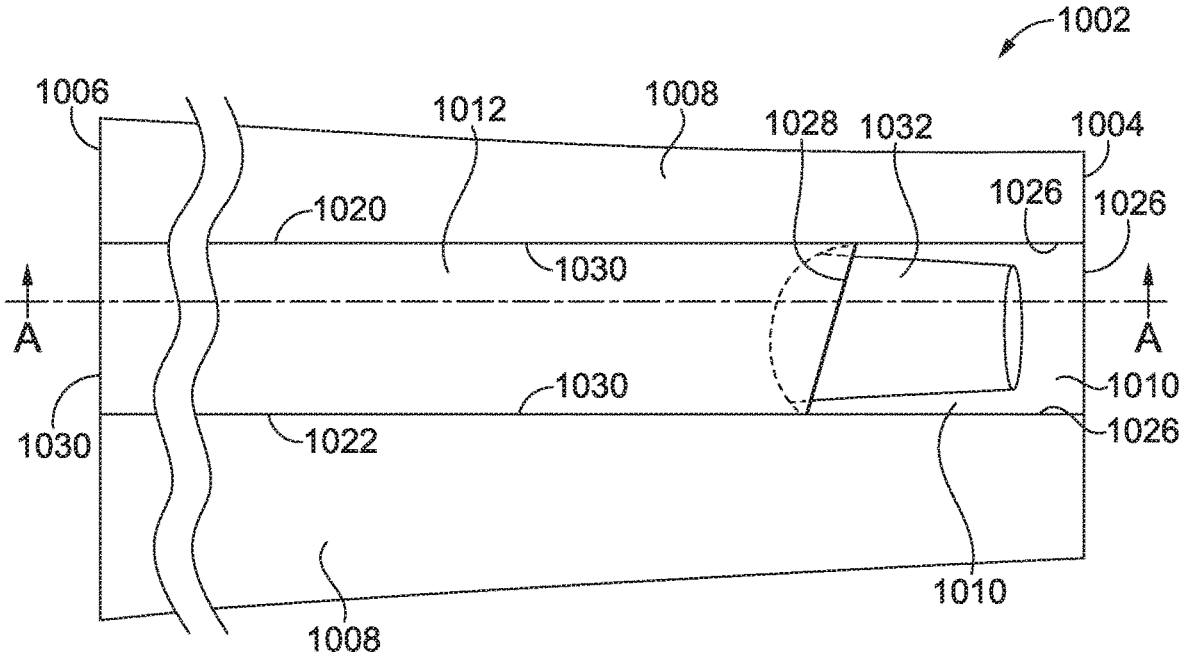
FIG. 15 illustrates a detail view of a distal end of the sleeve shown in FIG. 14 with a cylindrical sheath extending through an opening in the sleeve, in accordance with an aspect herein.

Turning now to FIG. 15, the tubular sleeve 1002 also includes a cylindrical sheath 1032 (which may otherwise herein be known as a thumb sheath) configured to move between a first in-use configuration and a second in-use configuration. The cylindrical sheath 1032 is positioned entirely within the interior volume of the tubular sleeve 1002 in the first in-use configuration (e.g., FIG. 14). The cylindrical sheath 1032 extends through the opening to an exterior of the tubular sleeve 1002 in the second in-use configuration (e.g., FIG. 15).

The cylindrical sheath 1032 may be coupled to an interior surface of one or more of the sleeve wall 1008, the distal strap 1010, or the anterior patch 1012. In some aspects, the cylindrical sheath 1032 is joined to the tubular sleeve 1002 around the perimeter of the opening between the distal strap trailing edge 1024 and the anterior patch leading edge 1028. The curved dashed line in FIG. 15 reflects hidden portions of the cylindrical sheath 1032. The distal strap trailing edge 1024 is not shown in FIG. 15.

Figure 16:
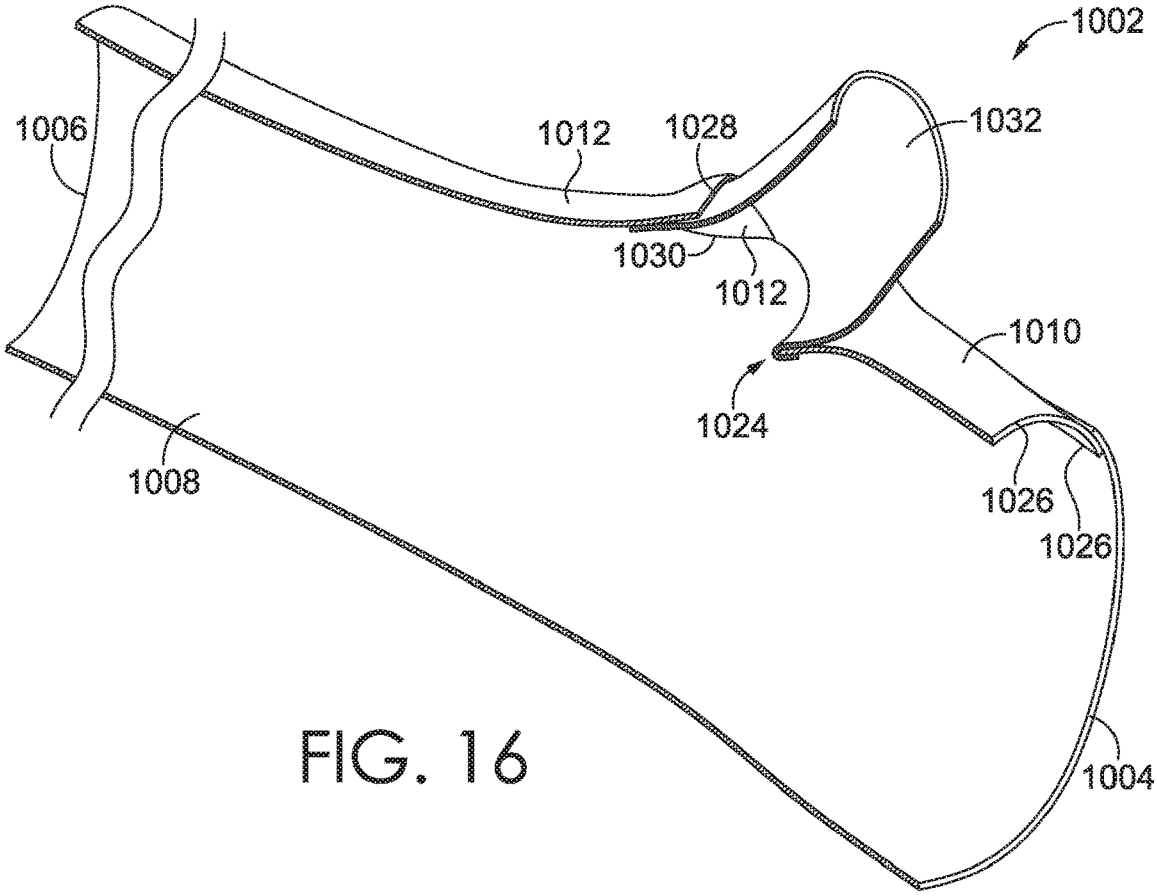
FIG. 16 illustrates a detail view of the distal end of the sleeve shown in FIG. 15 having a thumb extending through the cylindrical sheath, in accordance with an aspect described herein.
Figure 17:
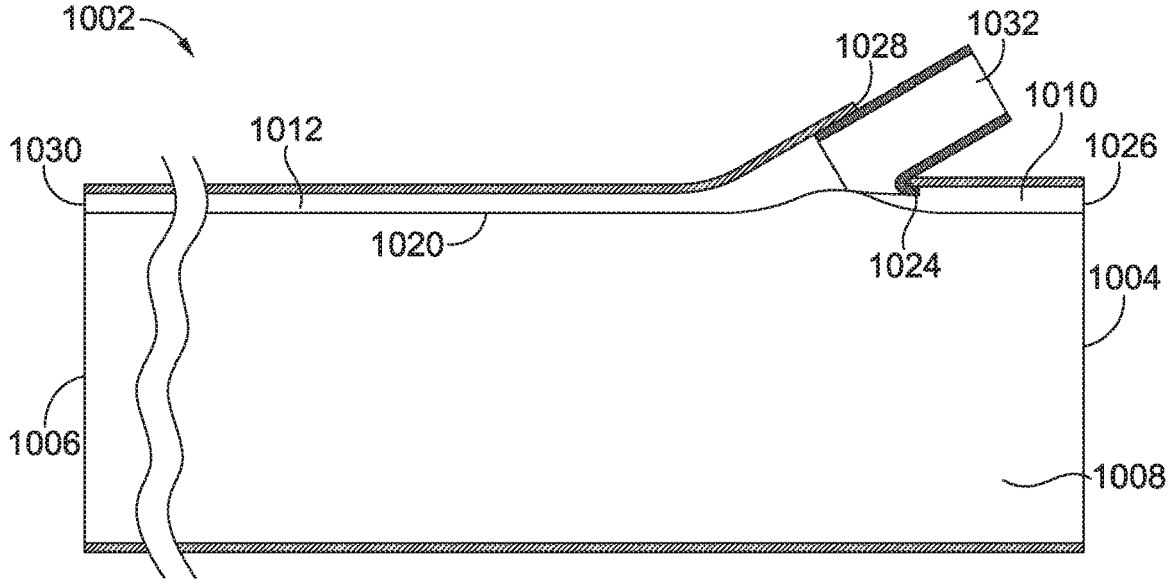
FIG. 17 illustrates a detail view of the distal end of the sleeve shown in FIG. 15 having a thumb extending through the cylindrical sheath, in accordance with an aspect described herein.

One possible construction of the tubular sleeve 1002 is shown in the cross-section views of FIGS. 16 and 17, which are taken about the cut line A-A in FIG. 15. FIGS. 16 and 17 illustrate the cylindrical sheath 1032 in the second in-use configuration (e.g., the cylindrical sheath 1032 has been pulled through the opening between the distal strap trailing edge 1024 and the anterior patch leading edge 1028). In the aspect shown, the cylindrical sheath 1032 is affixed to an inner surface of the anterior patch 1012 and to an inner surface of distal strap 1010. In particular, in this aspect, the cylindrical sheath 1032 is joined to the tubular sleeve 1002 by stitching. In other aspects, the cylindrical sheath 1032 may be joined to the tubular sleeve 1002 with any other type of coupling contemplated herein (e.g., bonding, welding, adhesives, and the like). In yet other aspects, the cylindrical sheath 1032 may be formed integral with one or more of the sleeve wall 1008, the distal strap 1010, or the anterior patch 1012. In other words, the cylindrical sheath 1032, the sleeve wall 1008, the distal strap 1010, and/or the anterior patch 1012 may be formed in a single knitting or weaving event.

As discussed herein, the cylindrical sheath 1032 is configured to move between a first in-use configuration where it is positioned entirely within the interior volume of the tubular sleeve 1002 and the second in-use configuration where it is extended through the opening between the distal strap 1010 and the anterior patch 1012. For example, when a wearer dons the tubular sleeve 1002, they may extend their arm completely through the tubular sleeve 1002 such that their hand passes in through the proximal end 1006 and out through the distal end 1004. In this example, the wearer's hand is not positioned adjacent to the opening or the cylindrical sheath 1032. Thus, the cylindrical sheath 1032 may be retracted into an interior volume of the tubular sleeve 1002, and the overlapping of the distal strap 1010 and the anterior patch 1012 presents a substantially closed state of the opening, while the cylindrical sheath 1032 is in the first in-use configuration. The substantially closed state of the opening prevents environmental intrusion into the interior of the tubular sleeve 1002 (e.g., cold, wind, rain, etc.).

Figure 18:
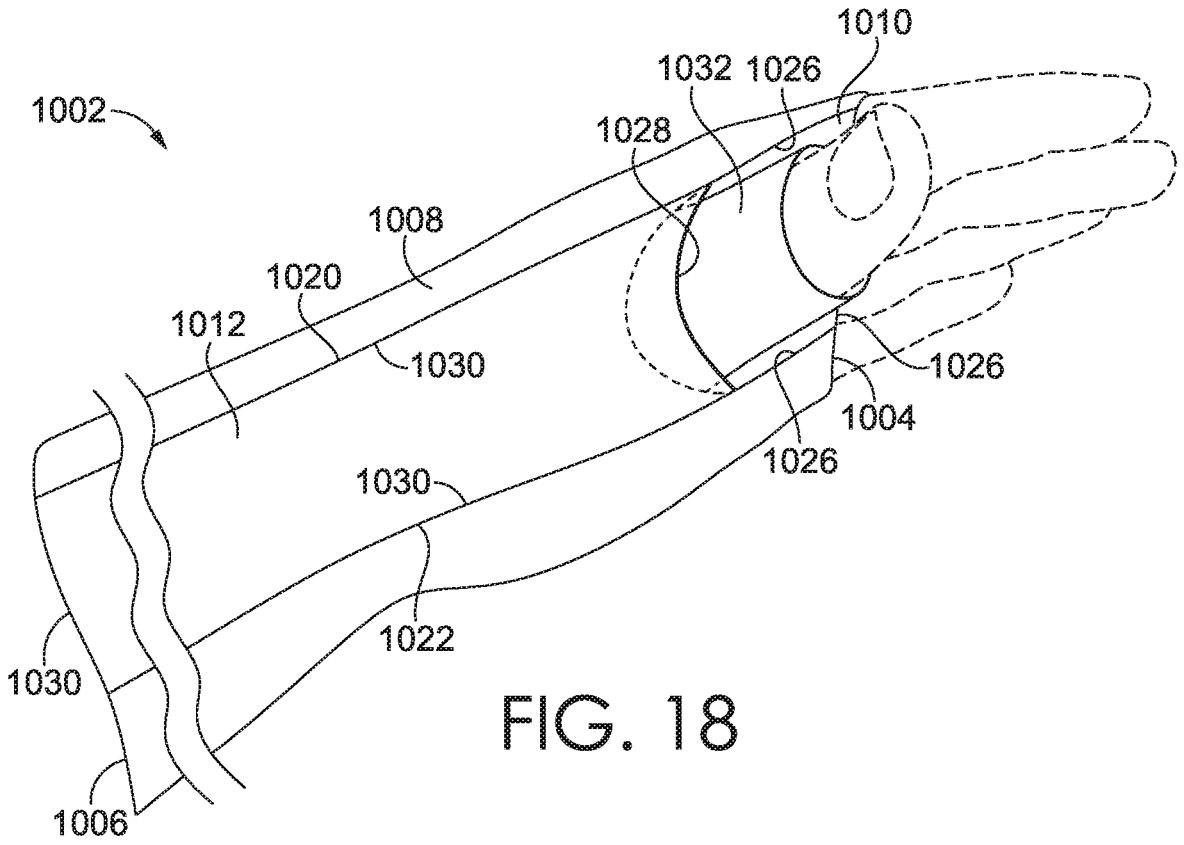
FIG. 18 illustrates a detail view of another distal end of the sleeve similar to that shown in FIG. 17 except for the cylindrical sheath being fully-enclosed, in accordance with an aspect described herein.
Figure 19:
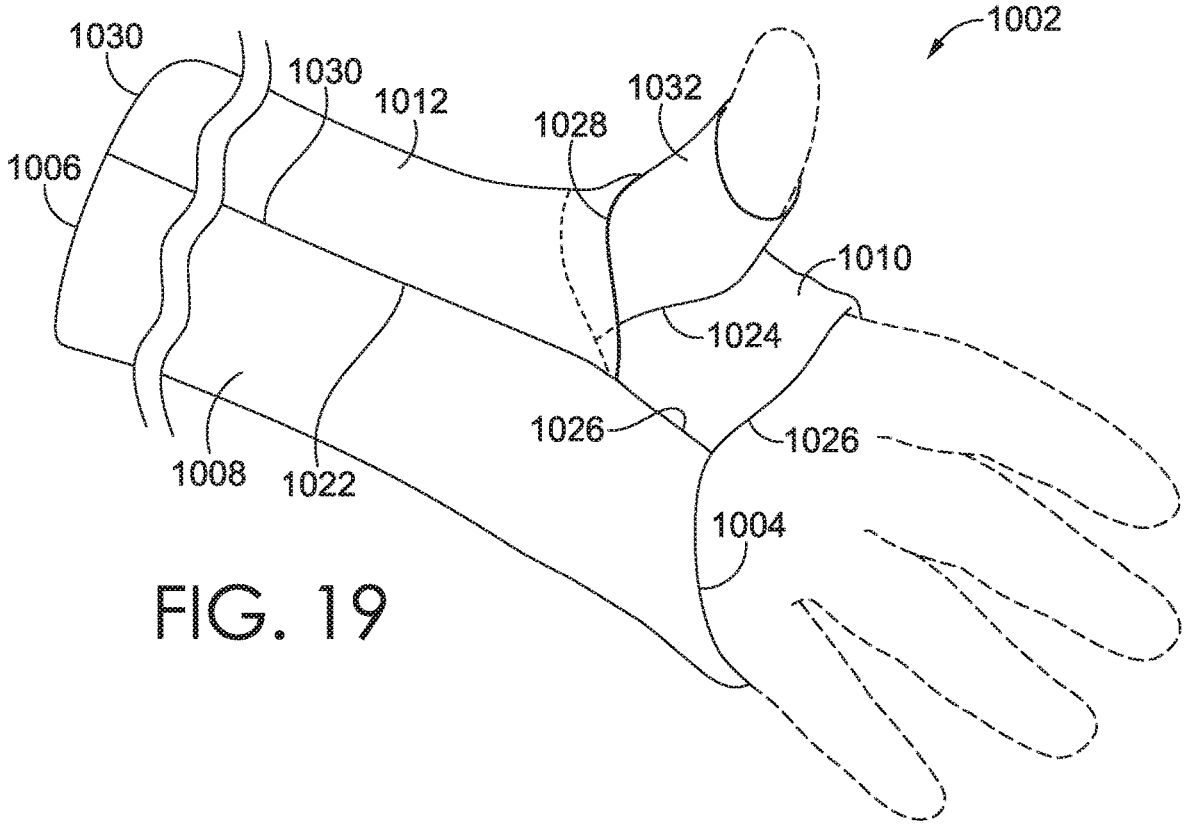
FIG. 19 illustrates a perspective view of a cross-section taken along line A-A of the sleeve illustrated in FIG. 15, in accordance with an aspect described herein.

FIGS. 18 and 19 illustrate the cylindrical sheath 1032 in the second in-use configuration. As illustrated, a wearer has extended their arm mostly through the tubular sleeve 1002. In this aspect, the wearer's hand has passed through the proximal end 1006 but has only partially passed through the distal end 1004 (e.g., the digits and a distal portion of the palm have passed through the distal end 1004). The wearer's hand, particularly the wearer's thumb, is positioned adjacent to the opening and the cylindrical sheath 1032. Moreover, the wearer's thumb has extended through the cylindrical sheath 1032. In the illustrated second in-use configuration, a greater amount of the wearer's hand, palm, and thumb are covered, which provides additional protection from environmental elements (e.g., cold, wind, rain, etc.). In addition, having the cylindrical sheath 1032 joined to the tubular sleeve around the perimeter of the opening between the distal strap 1010 and the anterior patch 1012 minimizes or eliminates the environmental intrusion into the interior of the tubular sleeve 1002 through the opening.

Figure 20:
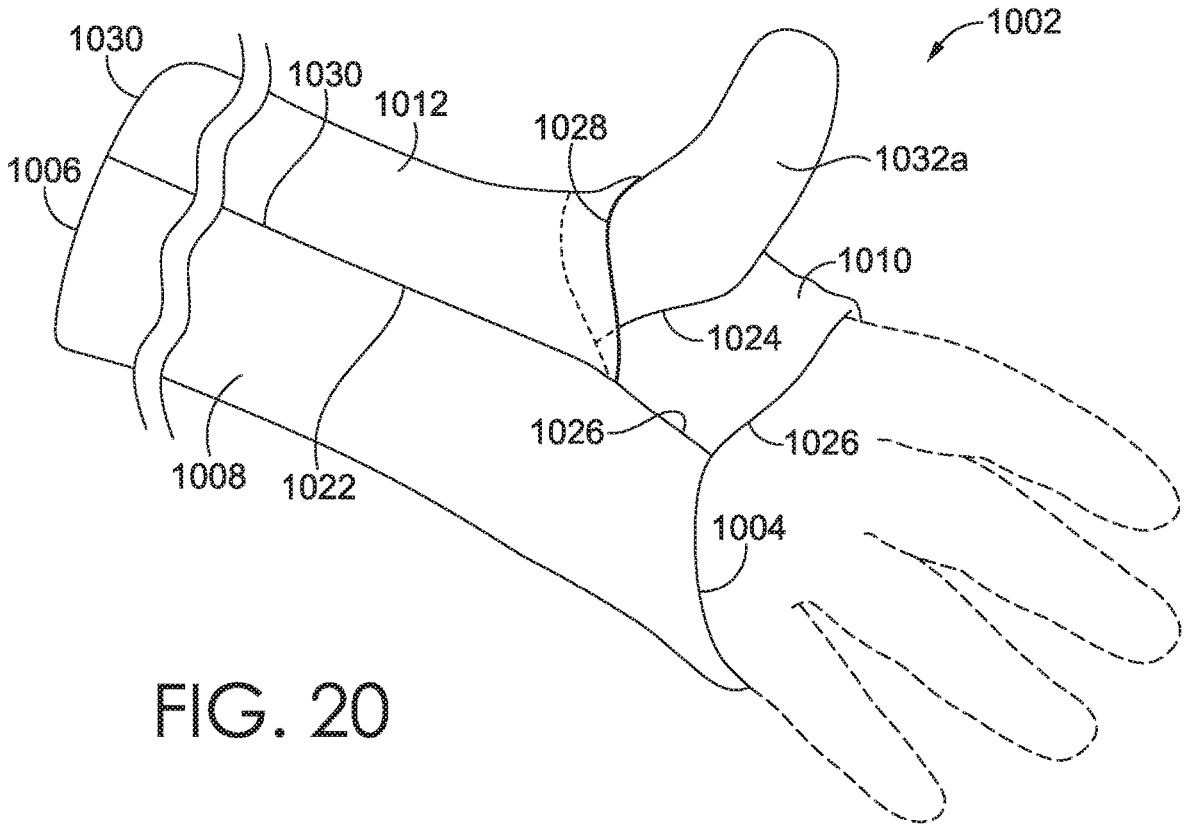
FIG. 20 illustrates a top view of the cross-section taken along line A-A of the sleeve illustrated in FIG. 15, in accordance with an aspect described herein.

As is seen in FIGS. 15-19, the cylindrical sheath 1032 may have a tubular shape (e.g., cylindrical, conical, etc.), in accordance with some aspects. In addition, the end of the cylindrical sheath 1032 may have a secondary aperture configured to permit a portion of a wearer's thumb to extend out of the cylindrical sheath 1032. In such aspects, the cylindrical sheath 1032 may have a frustoconical shape. As is seen in FIG. 20, other aspects of the cylindrical sheath **1032*a* do not have a secondary aperture. For example, a wearer's thumb received in the cylindrical sheath 1032*a* is entirely enclosed by the cylindrical sheath 1032*a*. In other aspects, the cylindrical sheath 1032** may have any geometric shaped cross-section or even an irregularly shaped cross-section.

Other aspects of a tubular sleeve will now be described in reference to FIGS. 21-28. The tubular sleeve described herein may relate to a sleeve affixed to, or integral with, a garment (e.g., a shirt). The tubular sleeve described herein may also relate to a stand-alone garment (e.g., a sleeve configured to enclose at least a portion of an arm of a wearer). The tubular sleeve illustrated in FIGS. 21-28 is similar to the tubular sleeve shown in FIGS. 14-20 but includes a retractable mitten. These additional features, however, may also be applied to the tubular sleeve shown in FIGS. 1-12, or other tubular sleeves. For sake of brevity, the description of the features included on the tubular sleeve shown in FIGS. 14-20 will not be repeated and like features will have like reference numbers in FIGS. 21-28.

Figure 21:
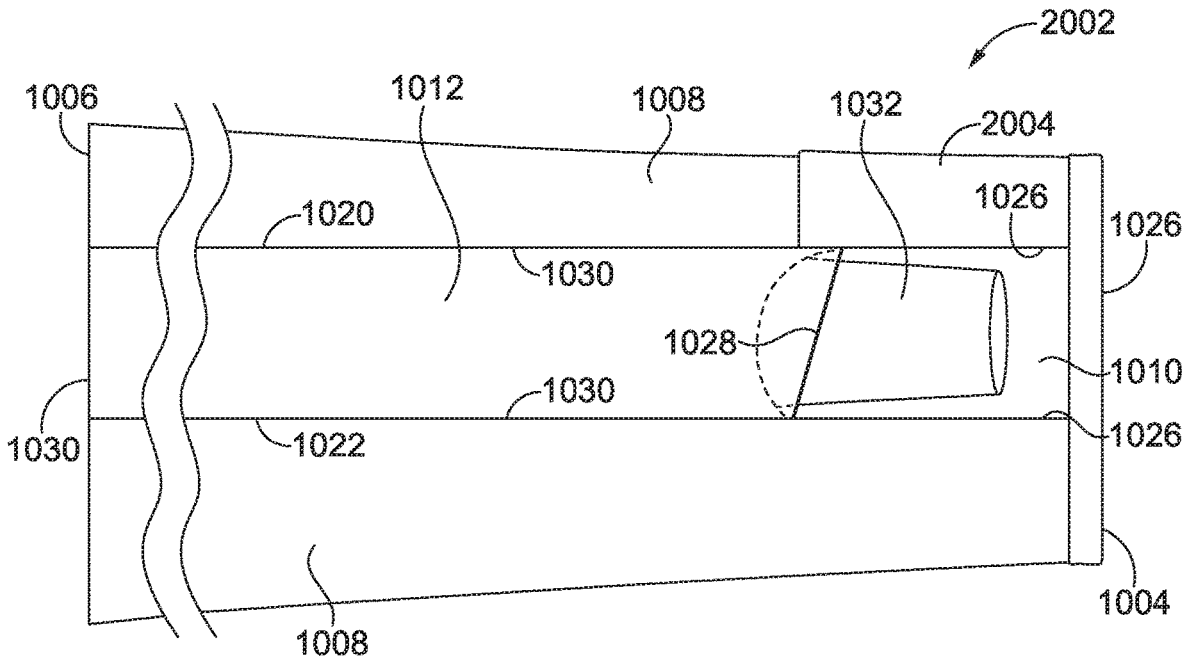
FIG. 21 illustrates a front view of a sleeve having an overlapping anterior patch and distal strap, a cylindrical sheath in an extended position communicated through an aperture in the sleeve, and a retractable mitten, in accordance with an aspect described herein.
Figure 22:
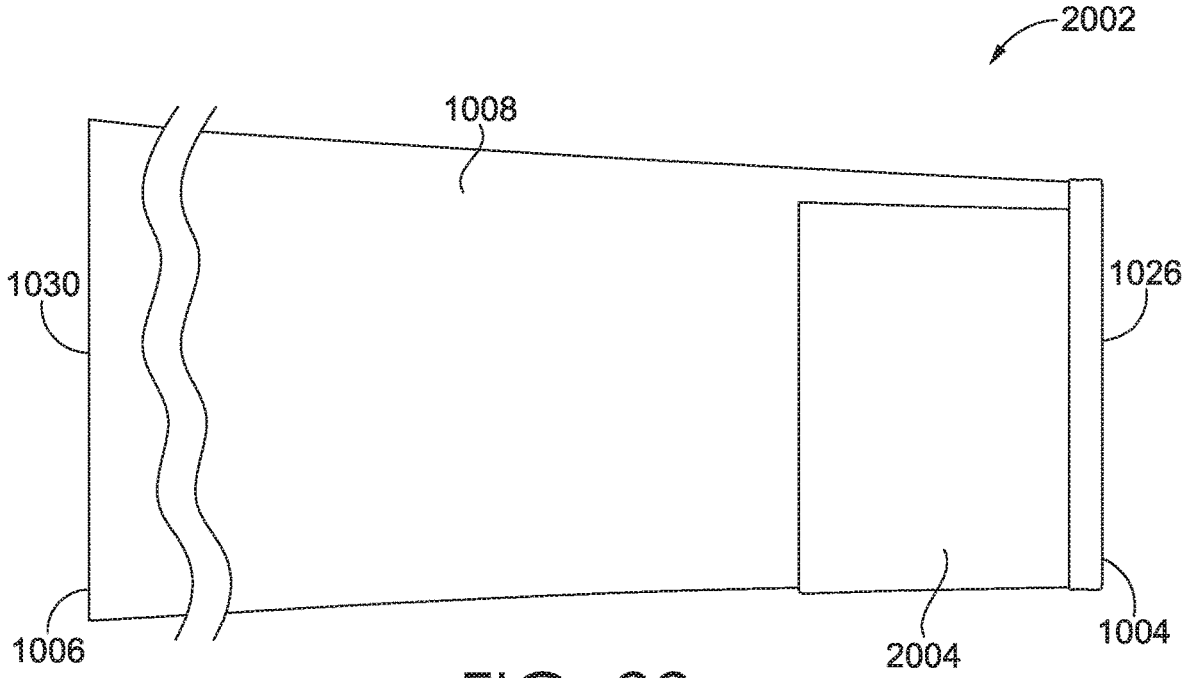
FIG. 22 illustrates a rear view of the sleeve shown in FIG. 21, in accordance with an aspect described herein.
Figure 23:
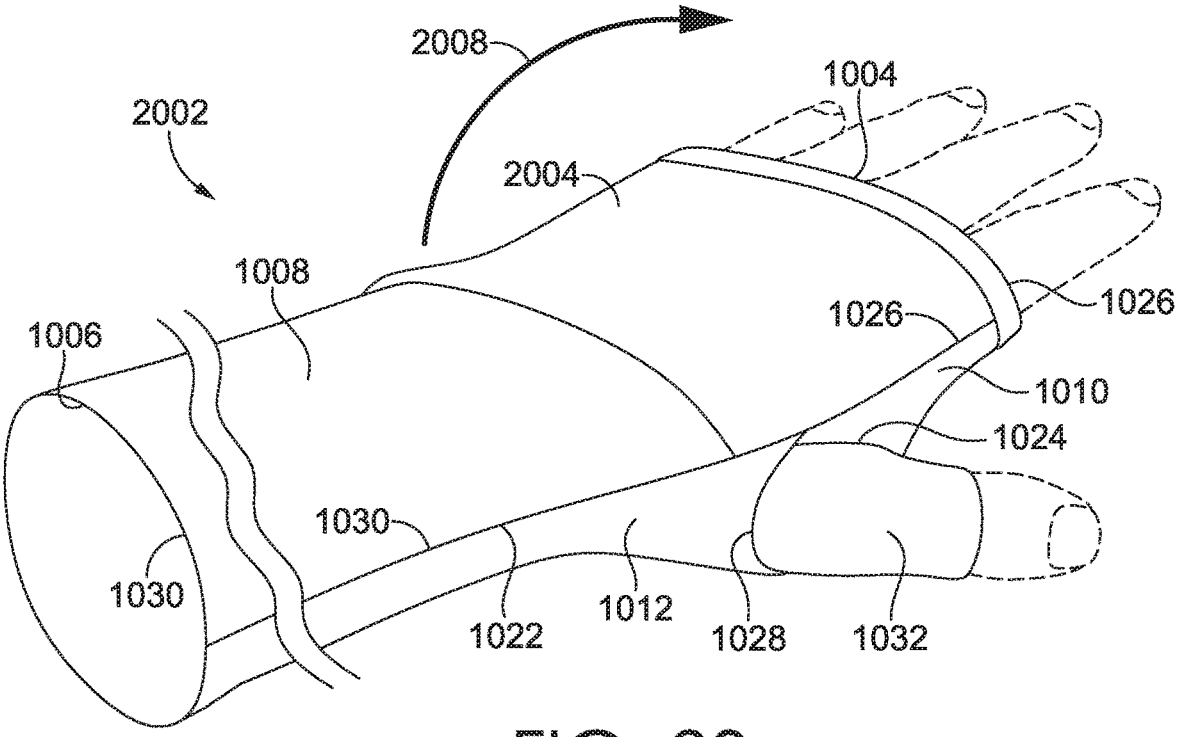
FIG. 23 illustrates a detail view of the sleeve shown in FIG. 21 and having a thumb extending through the cylindrical sheath and digits extending out an end of the sleeve while the retractable mitten is in a first state, in accordance with an aspect described herein.
Figure 24:
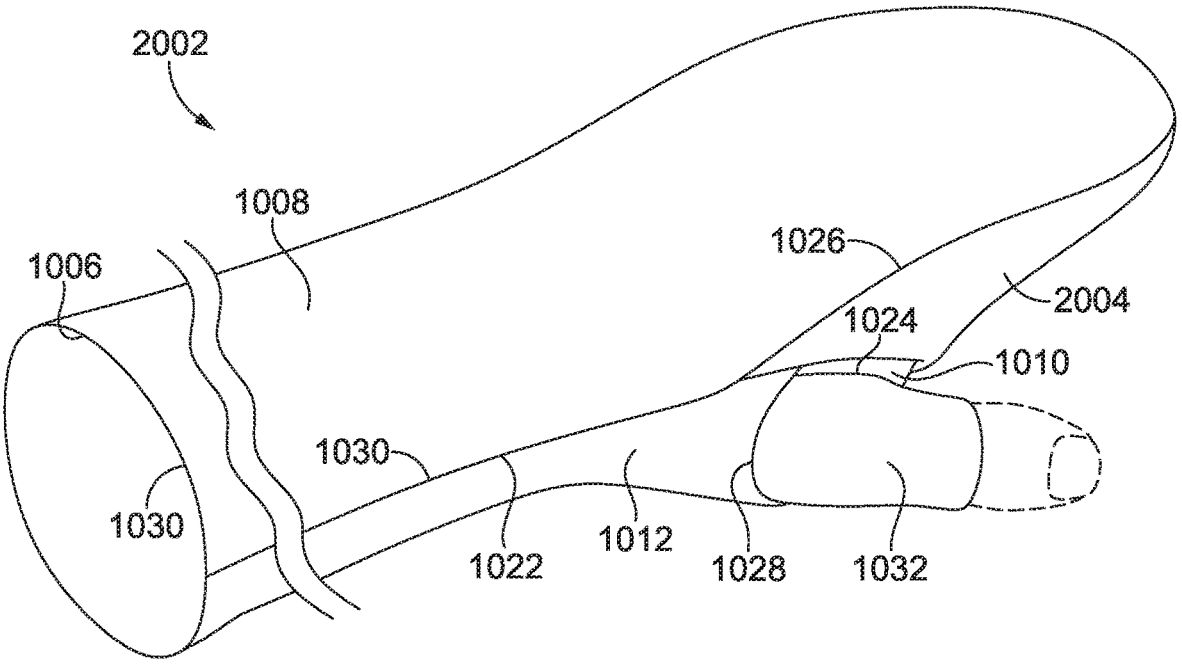
FIG. 24 illustrates a detail view of the sleeve shown in FIG. 21 and having a thumb extending through the cylindrical sheath while the retractable mitten is in a second state that is folded over the end of the sleeve, in accordance with an aspect described herein.
Figure 25:
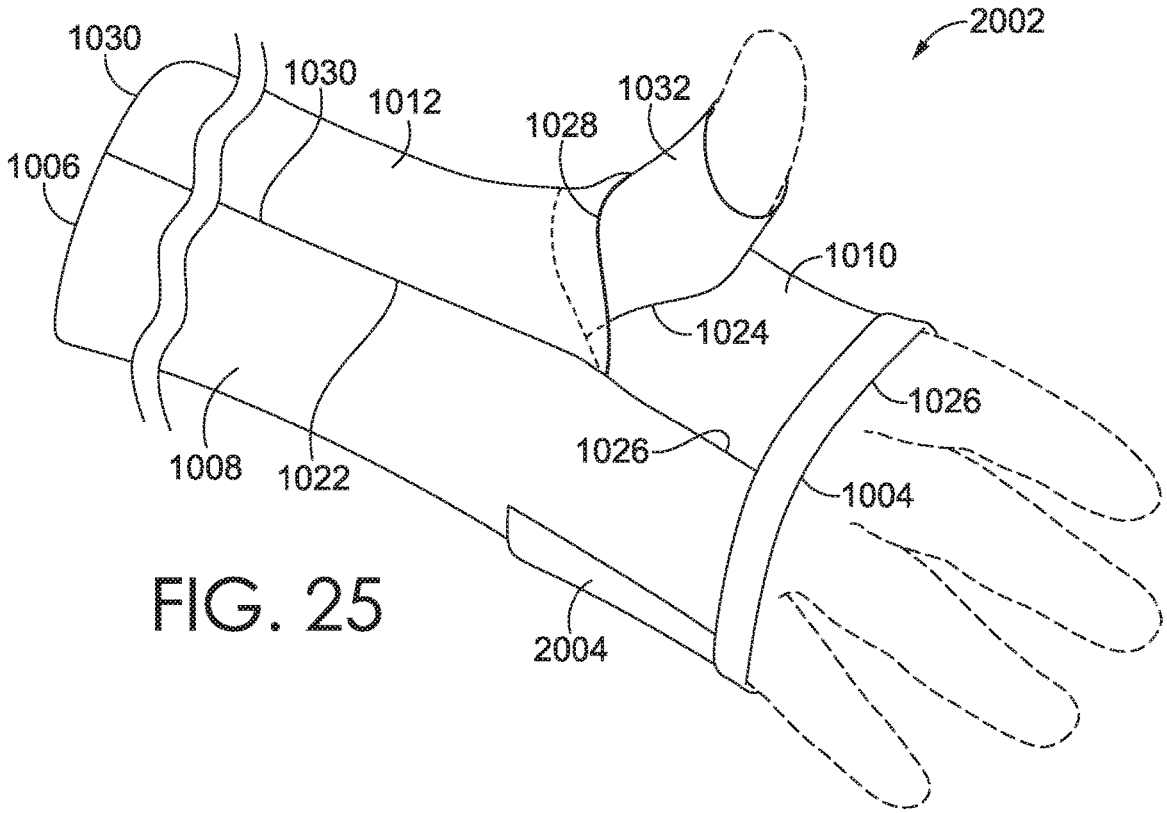
FIG. 25 illustrates another detail view of the sleeve shown in FIG. 23, in accordance with an aspect described herein.
Figure 26:
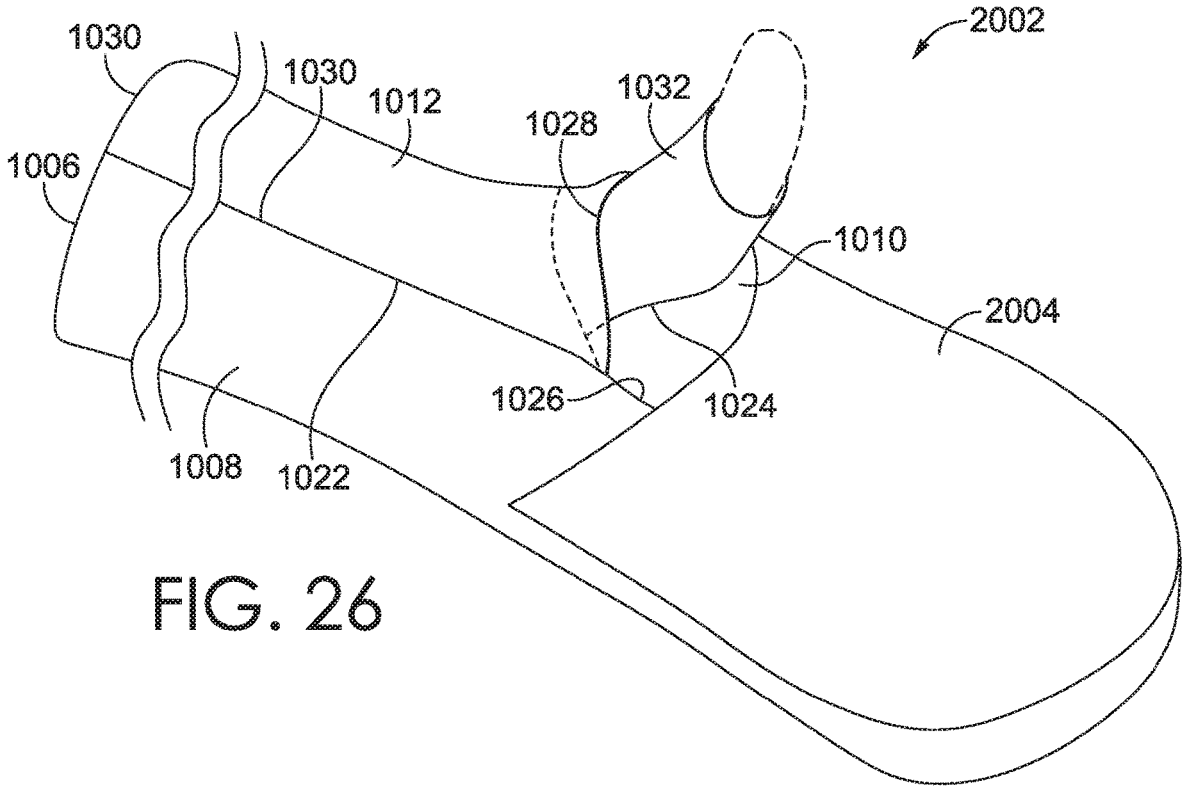
FIG. 26 illustrates another detail view of the sleeve shown in FIG. 24, in accordance with an aspect described herein.

Referring to FIGS. 21 and 22, which illustrate a front view and a rear view respectively, a tubular sleeve 2002 may include a foldable or retractable mitten 2004. The retractable mitten 2004 may be coupled to an outer surface of the sleeve wall 1008 of the tubular sleeve 2002. In the illustrated aspect, the retractable mitten 2004 comprises a panel having a perimeter. A portion of the perimeter of the panel is affixed to the sleeve wall 1008 of the tubular sleeve 2002. For example, the panel may have a distal edge, a first side edge, a second side edge and a proximal edge. In the illustrated aspect, the first side edge, the second side edge and the distal edge are affixed to the sleeve wall 1008 while the proximal edge is unaffixed. In other aspects, the panel may have one or more edges and any number of the one or more edges may be affixed to the sleeve wall 1008 so long as the perimeter of the panel is only partially affixed thereto.

In this way, the retractable mitten 2004 is configured to move between a first mitten in-use state and a second mitten in-use state. The retractable mitten 2004 is shown in the first mitten in-use state in FIGS. 23 and 25. The retractable mitten 2004 is shown in the second mitten in-use state in FIGS. 24 and 26. As indicated by the arrow 2008 in FIG. 23, the proximal edge of the panel (which is unaffixed in the illustrated aspect) may be pulled distally around the distal end 1004 of the tubular sleeve 2002. In this way the retractable mitten 2004 may enclose digits and/or a portion of a wearer's hand, which may provide additional protection from environmental conditions (e.g. wind, cold temperatures, rain, and the like).

Figure 27:
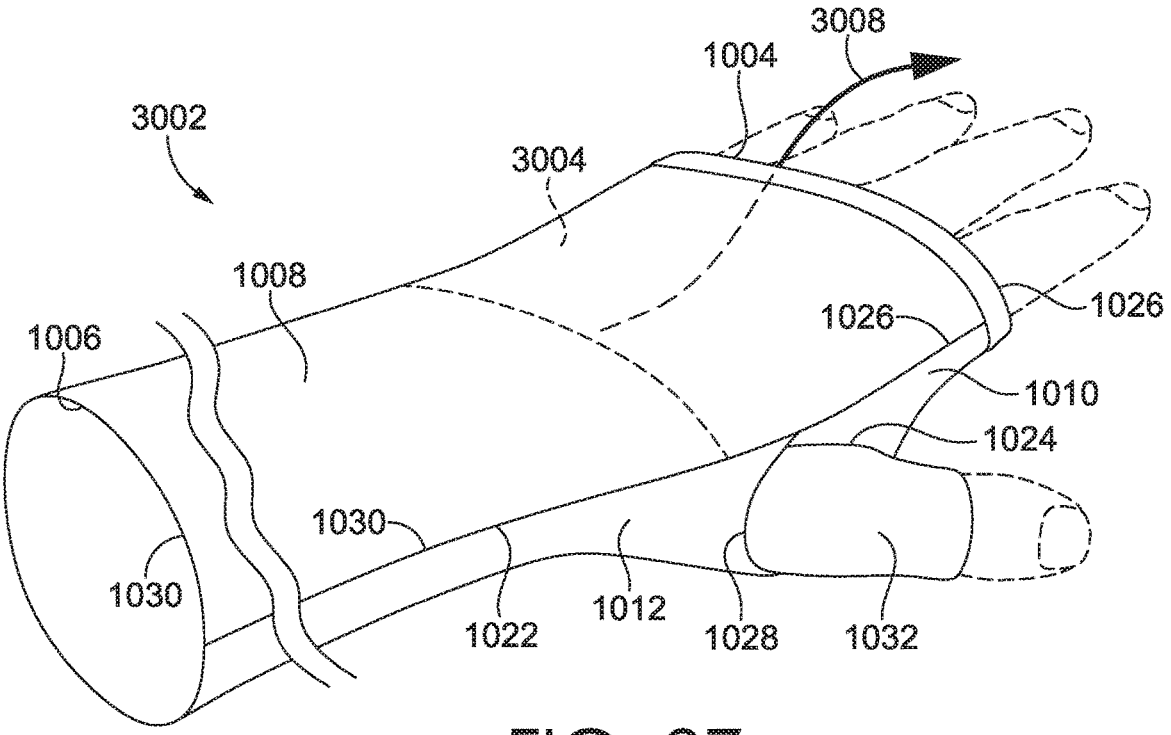
FIG. 27 illustrates a sleeve having an overlapping anterior patch and distal strap, a cylindrical sheath in an extended position communicated through an aperture in the sleeve, and a retractable mitten positioned in a first state, in accordance with an aspect described herein.
Figure 28:
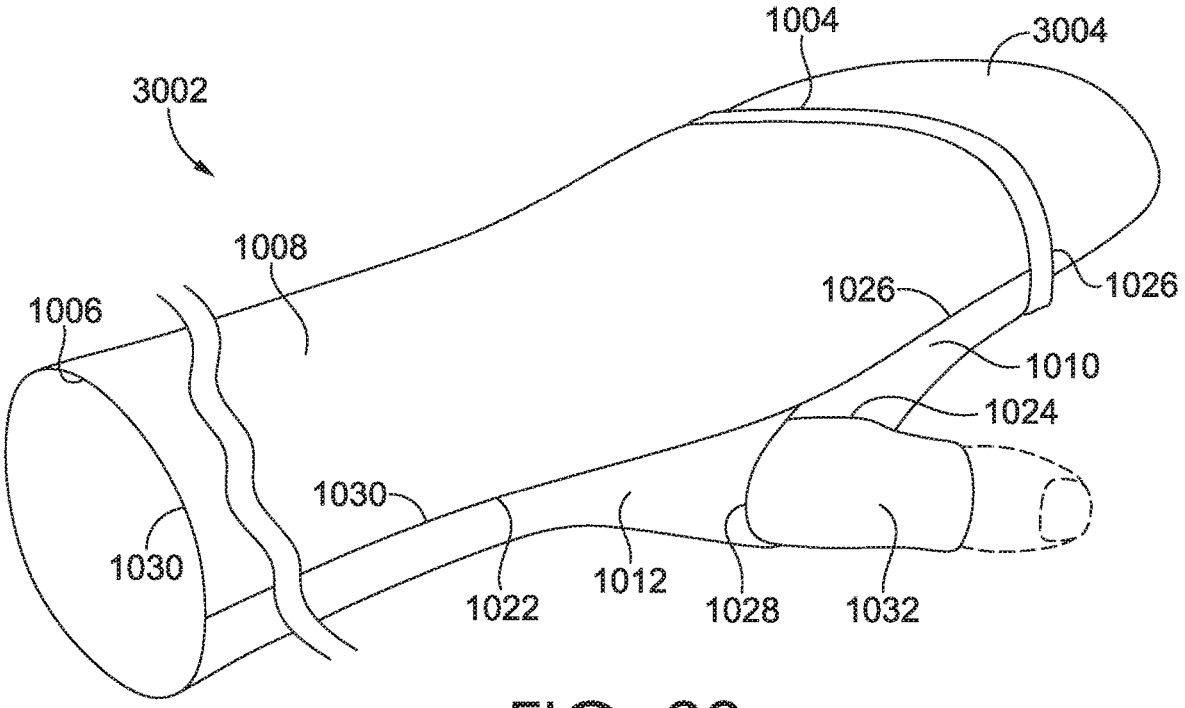
FIG. 28 illustrates a detail view of the sleeve shown in FIG. 28 where the retractable mitten is in a second state that is folded over the end of the sleeve, in accordance with an aspect described herein.

An alternative configuration of a tubular sleeve 3002 having a retractable mitten 3004 is shown in FIGS. 27 and 28. In this aspect, the retractable mitten 3004 is affixed to an inner surface of the sleeve wall 1008. In the illustrated aspect, the retractable mitten 3004 comprises a reversible pocket having a first panel affixed to the inner surface of the sleeve wall 1008 along a portion of the perimeter of the first panel. In aspects, the proximal perimeter edge of the first panel is unaffixed to the inner surface of the sleeve wall 1008.

When in use, the retractable mitten 3004 is configured to move between a first mitten in-use state and a second mitten in-use state. The retractable mitten 3004 is shown in the first mitten in-use state in FIG. 27 and shown in the second in-use state in FIG. 28. As indicated by the arrow 3008 in FIG. 27, the retractable mitten 3004 may be pushed out or extended out of the distal end 1004 of the tubular sleeve 3002. In this way the proximal perimeter edge of the first panel of the retractable mitten 3004 may provide an opening to receive and enclose digits and/or a portion of a wearer's hand, which may provide additional protection from environmental conditions (e.g. wind, cold temperatures, rain, and the like). In aspects, when the wearer positions her hand in the retractable mitten 3004, the wearer may then extend the retractable mitten 3004 out the distal end 1004 of the tubular sleeve 3002.

From the foregoing, it will be seen that aspects described herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects described herein may be made without departing from the scope thereof, it is to be understood that all matter herein set forth or shown in the accompanying drawings is to be interpreted as illustrative and not in a limiting sense.

What is claimed is:

1. A garment having a sleeve, the sleeve comprising:

a tube having a distal end opposite a proximal end;

a slot formed through the tube proximate the distal end, the slot defined in part by a first longitudinal edge and a second longitudinal edge, wherein the first longitudinal edge is positioned across the slot from the second longitudinal edge;

a first panel having a first panel trailing edge and a first panel leading edge, the first panel trailing edge extending across the slot from the first longitudinal edge to the second longitudinal edge, wherein the first panel is affixed to the tube proximate the distal end such that the distal end is defined in part by the tube and in part by the first panel leading edge;

a second panel having a second panel leading edge extending across the slot from the first longitudinal edge to the second longitudinal edge;

an aperture with a perimeter, the aperture in communication with an interior volume of the tube, the perimeter comprising at least a portion of the second panel leading edge and at least a portion of the first panel trailing edge; and a sheath joined to an interior of the tube and configured to extend through the aperture, wherein in a first in-use configuration the sheath is positioned entirely within the interior volume of the tube and the second panel leading edge continuously overlaps the first panel trailing edge from the first longitudinal edge to the second longitudinal edge such that from a perspective exterior to the tube and normal to the slot the sheath is covered by the first panel and the second panel and hidden from view from said perspective, and wherein in a second in-use configuration the sheath extends through the aperture to an outside of the tube.

2. The garment of claim 1, wherein the first panel includes a first side edge directly affixed to the first longitudinal edge, and a second side edge directly affixed to the second longitudinal edge, wherein the second panel is directly affixed to the first longitudinal edge and the second longitudinal edge such that the second panel spans at least a second portion of the slot.

3. The garment of claim 1, wherein the sheath comprises a first end opposite a second end, and wherein the first end is affixed proximate to the perimeter.

4. The garment of claim 3, wherein the second end of the sheath includes a secondary aperture configured to communicate at least a portion of a wearer's thumb through the secondary aperture.

5. The garment of claim 1, wherein the second panel has at least one trailing edge and wherein the at least one trailing edge of the second panel is affixed to one or both of the first longitudinal edge and the second longitudinal edge located proximal to the second panel leading edge, such that the second panel completely covers a portion of the slot located proximal to the second panel leading edge.

6. The garment of claim 1, wherein the second panel leading edge and the first panel trailing edge extend across the slot in parallel alignment with each other.

7. The garment of claim 1, wherein:

the first panel trailing edge has a first end opposite a second end, the first end associated with the first longitudinal edge, the second end associated with the second longitudinal edge, the second panel leading edge has a third end opposite a fourth end, the third end associated with the first longitudinal edge, the fourth end associated with the second longitudinal edge, the first end of the first panel trailing edge is positioned proximal to the second end of the first panel trailing edge, and the third end of the second panel leading edge is positioned proximal to the fourth end of the second panel leading edge.

8. The garment of claim 1, wherein the first panel and the second panel are made of an elastic material.

9. The garment of claim 1, wherein the first panel and the second panel are joined to the tube along the first longitudinal edge at a first seam and joined to the second longitudinal edge at a second seam.

10. The garment of claim 1, wherein the first panel and the second panel are made of a knit material.

11. The garment of claim 1 further comprising a retractable mitten coupled to the sleeve and configured to move between a first in-use state and a second in-use state, wherein the retractable mitten is positioned entirely on a dorsal side of the tube when in the first in-use state, wherein the retractable mitten is positioned in part on the dorsal side of the tube and in part on a palmar side of the tube when in the second in-use state.

12. A garment having a sleeve, the sleeve comprising:

a tube having a distal end opposite a proximal end;

a slot formed through the tube proximate the distal end, the slot defined in part by a first longitudinal edge and a second longitudinal edge, wherein the first longitudinal edge is positioned across the slot from the second longitudinal edge;

a first panel having a first panel trailing edge and a first panel leading edge, the first panel trailing edge extending across the slot from the first longitudinal edge to the second longitudinal edge, wherein the first panel is affixed to the tube proximate the distal end such that the distal end is defined in part by the tube and in part by the first panel leading edge;

a second panel having a second panel leading edge extending across the slot from the first longitudinal edge to the second longitudinal edge;

an aperture with a perimeter, the aperture in communication with an interior volume of the tube, the perimeter comprising at least a portion of the second panel leading edge and at least a portion of the first panel trailing edge; and a sheath configured to extend from inside the tube through the aperture and cover a portion of a wearer's thumb when the garment is donned, wherein in a first in-use configuration the sheath is positioned entirely within the interior volume of the tube and the second panel leading edge continuously overlaps the first panel trailing edge from the first longitudinal edge to the second longitudinal edge such that from a perspective exterior to the tube and normal to the slot the sheath is covered by the first panel and the second panel and hidden from view from said perspective, and wherein in a second in-use configuration the sheath extends through the aperture to an outside of the tube.

13. The garment of claim 12, wherein the first panel includes a first side edge directly affixed to the first longitudinal edge, and a second side edge directly affixed to the second longitudinal edge, wherein the second panel is directly affixed to the first longitudinal edge and the second longitudinal edge such that the second panel spans at least a second portion of the slot.

14. The garment of claim 12, wherein the sheath comprises a first end opposite a second end, the second end including a secondary aperture configured to communicate at least a portion of a wearer's thumb through the secondary aperture.

15. The garment of claim 12, wherein the sheath fully encloses a wearer's thumb when the sheath is in the second in-use configuration, when worn.

* * * * *